US010773280B2

(12) United States Patent
Yamamoto et al.

(10) Patent No.: US 10,773,280 B2
(45) Date of Patent: Sep. 15, 2020

(54) ULTRASONIC TREATMENT APPARATUS

(71) Applicant: C. Uyemura & Co., Ltd., Osaka (JP)

(72) Inventors: Hisamitsu Yamamoto, Osaka (JP); Masayuki Utsumi, Osaka (JP); Yoshikazu Saijo, Osaka (JP); Tomoji Okuda, Osaka (JP); Yutaka Nishinaka, Osaka (JP); Yoshinori Nakanishi, Osaka (JP)

(73) Assignee: C. UYEMURA & CO., LTD., Osaka (JP)

( * ) Notice: Subject to any disclaimer, the term of this patent is extended or adjusted under 35 U.S.C. 154(b) by 234 days.

(21) Appl. No.: 15/800,751

(22) Filed: Nov. 1, 2017

(65) Prior Publication Data

US 2018/0133760 A1 May 17, 2018

(30) Foreign Application Priority Data

Nov. 10, 2016 (JP) ..... 2016-219856

(51) Int. Cl.
*B08B 3/12* (2006.01)

(52) U.S. Cl.
CPC ..... *B08B 3/123* (2013.01)

(58) Field of Classification Search
CPC ..... B08B 3/123
USPC ..... 134/184
See application file for complete search history.

(56) References Cited

U.S. PATENT DOCUMENTS 5,067,983 A * 11/1991 Uchino ..... C23G 5/02 134/1
5,617,887 A * 4/1997 Shibano ..... B08B 3/123 134/1

FOREIGN PATENT DOCUMENTS

| | | |
|---|---|---|
| JP | 4-66177 | 3/1992 |
| JP | 2000-107710 | 4/2000 |
| JP | 2009-166028 | 7/2009 |

OTHER PUBLICATIONS

JPH0466177A—machine translation (Year: 1992).*
JP2009166028A—machine translation (Year: 2009).*
Japanese Office Action dated Sep. 25, 2018 in corresponding Japanese Patent Application No. 2016-219856 with English translation.

* cited by examiner

*Primary Examiner* — Tinsae B Ayalew
(74) *Attorney, Agent, or Firm* — Wenderoth, Lind & Ponack, L.L.P.

(57) ABSTRACT

An ultrasonic treatment apparatus including: an ultrasonic bath for performing an ultrasonic treatment on a treatment target object; a first ultrasonic vibrator provided on the front surface side of the treatment target object; and a second ultrasonic vibrator provided on the back surface side of the treatment target object; wherein the first ultrasonic vibrator does not face the second ultrasonic vibrator.

14 Claims, 17 Drawing Sheets

ULTRASONIC TREATMENT APPARATUS

CROSS REFERENCE TO RELATED APPLICATIONS

The present application claims priority to Japanese Patent Application No. 2016-219856 filed on Nov. 10, 2016, the entire contents of which are incorporated herein by reference.

BACKGROUND OF THE INVENTION

Field of the Invention

The present invention relates to ultrasonic treatment apparatuses and, in detail, relates to an ultrasonic treatment apparatus which performs a surface treatment with an ultrasonic wave on a treatment target object immersed in treatment liquid.

Description of the Related Art

Conventionally, an ultrasonic treatment apparatus is used to clean treatment target objects such as electronic components and printed circuit boards. For example, a printed circuit board is subjected to various treatments such as a desmear treatment; however, there are attached foreign substances such as a resin and smears on the surface of the printed circuit board after treatments. To address this issue, the printed circuit board is immersed in treatment liquid, and an ultrasonic treatment is then performed by oscillating an ultrasonic wave so that a cavitation action will remove the foreign substances and the smears attached on the printed circuit board surface.

Conventionally there are pointed out problems occurring in association with an ultrasonic treatment, and there is proposed an ultrasonic treatment apparatus with which the problems are reduced. For example, when the treatment liquid is flowing by circulation or the like, it is difficult to perform a uniform treatment with an ultrasonic wave, being affected by the flow.

As a solution to the above problem, for example, JP-A-2000-107710 discloses an ultrasonic substrate treatment apparatus in which an ultrasonic wave is transmitted toward a boundary plate disposed between the treatment liquid in the treatment liquid bath and the atmosphere.

SUMMARY OF THE INVENTION

In order to perform an ultrasonic treatment on both of the front surface and the back surface of a treatment target object, the present inventors studied a configuration in which an ultrasonic vibrator was provided at each of the positions each facing the front surface side and the back surface side of the treatment target object. However, if the ultrasonic vibrators were disposed at opposite positions, the ultrasonic wave resonated, and part of the ultrasonic oscillators constituting the ultrasonic vibrators got damaged in some cases. The ultrasonic wave was not sufficiently applied to the treatment target object facing the damaged ultrasonic oscillator; therefore, there was created an ultrasonic treatment non-uniformity. Further, the present inventors studied a configuration in which conveyance rollers were provided on the both sides of the treatment target object so as to sandwich the treatment target object as a guide to prevent or reduce wobble of the treatment target object at the time of the ultrasonic treatment and in which the treatment target object was moved between the conveyance rollers. However, when the ultrasonic vibrators are disposed on the outer sides of the conveyance rollers, the conveyance rollers interfere with the wave motions of the ultrasonic wave, thereby weakening the ultrasonic wave to be applied to part of the treatment target object facing the places at which the conveyance rollers were disposed. For this reason, there was created an ultrasonic treatment non-uniformity in the vertical direction of the treatment target object.

The present invention has been made in view of the above issues, and there is provided an ultrasonic treatment apparatus which can prevent an ultrasonic treatment non-uniformity. In particular, a first object of the present invention is to provide an ultrasonic treatment apparatus in which the ultrasonic oscillators constituting the ultrasonic vibrator provided in the ultrasonic bath can be prevented from being damaged so as to prevent or reduce an ultrasonic treatment non-uniformity. The second object is to provide an ultrasonic treatment apparatus in which the problem of the ultrasonic treatment non-uniformity caused by the guide member in the ultrasonic bath can be prevented or reduced.

The spirit of an ultrasonic treatment apparatus of the present invention which successfully solves the above issues is in a configuration which includes: an ultrasonic bath for performing an ultrasonic treatment on a treatment target object; a first ultrasonic vibrator which is provided on the front surface side of the treatment target object and oscillates an ultrasonic wave; and a second ultrasonic vibrator provided on the back surface side of the treatment target object and oscillates an ultrasonic wave, and the first ultrasonic vibrator does not face the second ultrasonic vibrator.

Each of the above ultrasonic vibrators preferably includes: a plurality of ultrasonic oscillators; and a plate member provided in contact with the ultrasonic oscillation side of the ultrasonic oscillators.

In another preferable aspect, the ultrasonic bath includes: a third ultrasonic vibrator provided in the front surface side of the treatment target object; and a fourth ultrasonic vibrator provided on the back surface side of the treatment target object. The ultrasonic oscillators are disposed such that any of the horizontal lines passing through the central parts of the ultrasonic oscillators constituting the first ultrasonic vibrator does not overlap any of the horizontal lines passing through the central parts of the ultrasonic oscillators constituting the third ultrasonic vibrator and such that any of the horizontal lines passing through the central parts of the ultrasonic oscillators constituting the second ultrasonic vibrator does not overlap any of horizontal lines passing through the central parts of the ultrasonic oscillators constituting the fourth ultrasonic vibrator.

Any of the following configurations is also a preferable aspect: the ultrasonic treatment apparatus of the present invention includes reflectors facing the ultrasonic vibrators; and the ultrasonic treatment apparatus of the present invention includes a conveyance mechanism for the treatment target object.

Further, it is also preferable that the ultrasonic treatment apparatus of the present invention be further equipped with; a front bath provided on an entrance side of the ultrasonic bath; and a rear hath provided on an exit side of the ultrasonic bath and that between the baths there be provided open/close mechanisms which open toward the ultrasonic bath side.

Further, the spirit of an ultrasonic treatment apparatus of the present invention is in a configuration which includes: an ultrasonic bath in which an ultrasonic treatment is performed on a treatment target object; an ultrasonic vibrator which transmits an ultrasonic wave toward the treatment target object; a conveyance mechanism for the treatment target object; a guide member facing a front surface of the treatment target object; a guide member facing a back surface of the treatment target object, and each of the guide members has a plurality of wire members formed on a vertical plane, and in addition, a longitudinal direction of each of the wire members being inclined with respect to the horizontal line.

In another aspect, each of the above guide members includes, at each end of the longitudinal direction of the plurality of wire members: a support pillar; and folding parts for the wire members, the folding parts being provided close to the support pillar, where each of the wire members passes through an outer circumference of one of the support pillars and is folded back at one of the folding parts, and then passes through the outer circumference of the one of the support pillars and is stretched to the other of the support pillars.

Further, any of the following configuration is a preferable aspect: the wire members have conductivity; each of the support pillars has a groove formed in a spiral manner; and each of the support pillars is provided with a horizontal position adjustment mechanism to adjust a distance to the treatment target object.

Any of the following configurations is a preferable aspect of the present invention: each of the ultrasonic vibrators is configured with a plurality of ultrasonic oscillators which oscillates at different frequencies; each of the ultrasonic vibrators simultaneously oscillates at at least two different frequencies; each of the ultrasonic vibrators is driven at a variable frequency; and each of the ultrasonic vibrators is provided with a horizontal position adjustment mechanism to adjust a distance to the treatment target object.

According to the first configuration of the present invention, since the ultrasonic vibrators are disposed not to face each other, resonation is reduced; therefore, the ultrasonic oscillators can be prevented from getting damaged, and the creation of an ultrasonic treatment non-uniformity can be prevented or reduced. Further, according to the second configuration of the present invention, since the longitudinal direction of each of the guides provided in the ultrasonic bath is inclined with respect to the horizontal line, it is possible to prevent or reduce the creation of an ultrasonic treatment non-uniformity in the vertical direction of the treatment target object. In addition, the combination of the first configuration and the second configuration of the present invention can provide an ultrasonic bath in which the creation of an ultrasonic treatment non-uniformity of the treatment target object can be more effectively prevented or reduced.

DETAILED DESCRIPTION OF THE PREFERRED EMBODIMENTS

Figure 1:
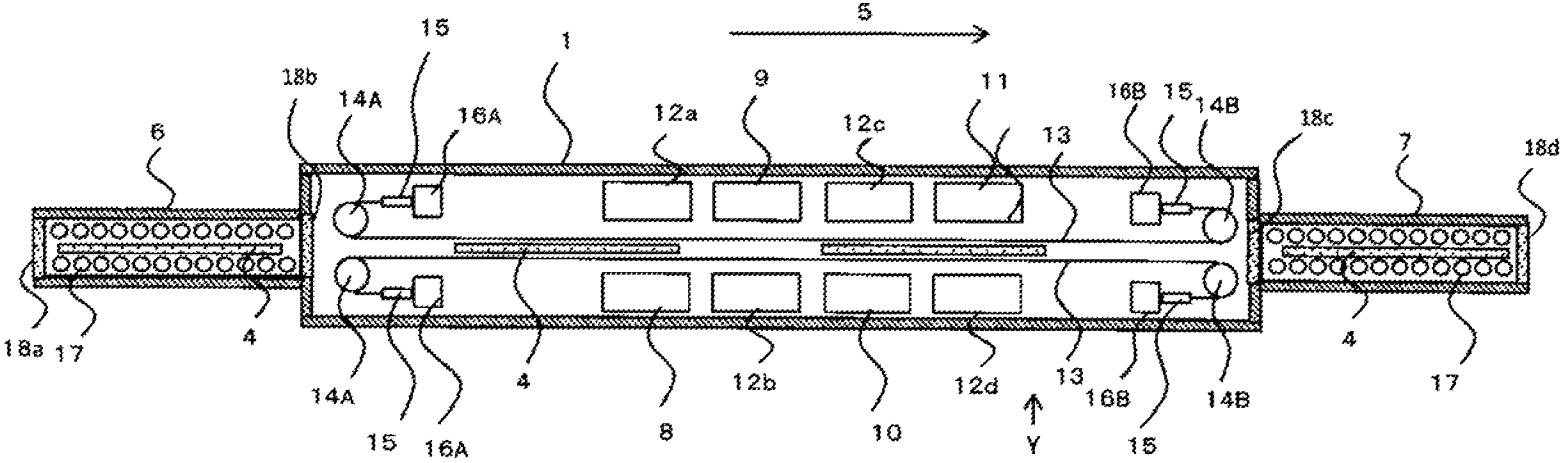
FIG. 1 is a plan view of an ultrasonic treatment apparatus of an embodiment of the present invention when viewed from above.

Hereinafter, the best mode for carrying out the present invention will be described in detail with reference to the drawing; however, the present invention is not limited to the following embodiments.

Figure 2:
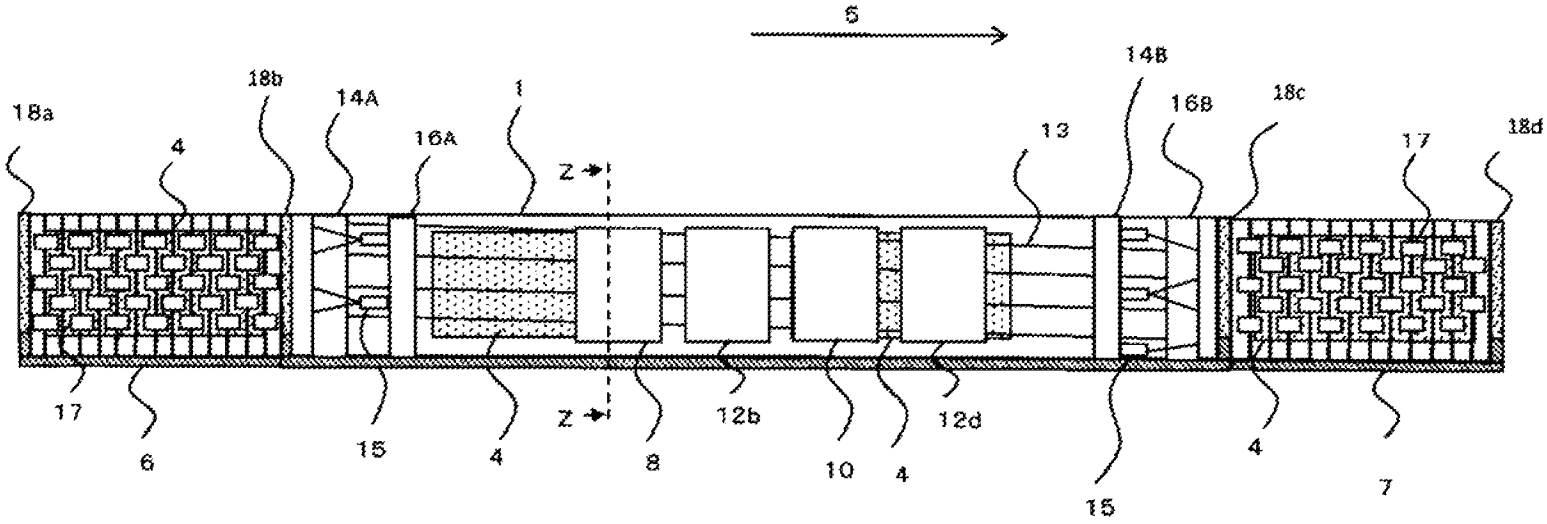
FIG. 2 is a side view of the ultrasonic treatment apparatus of FIG. 1 when viewed from the Y direction.
Figure 8:
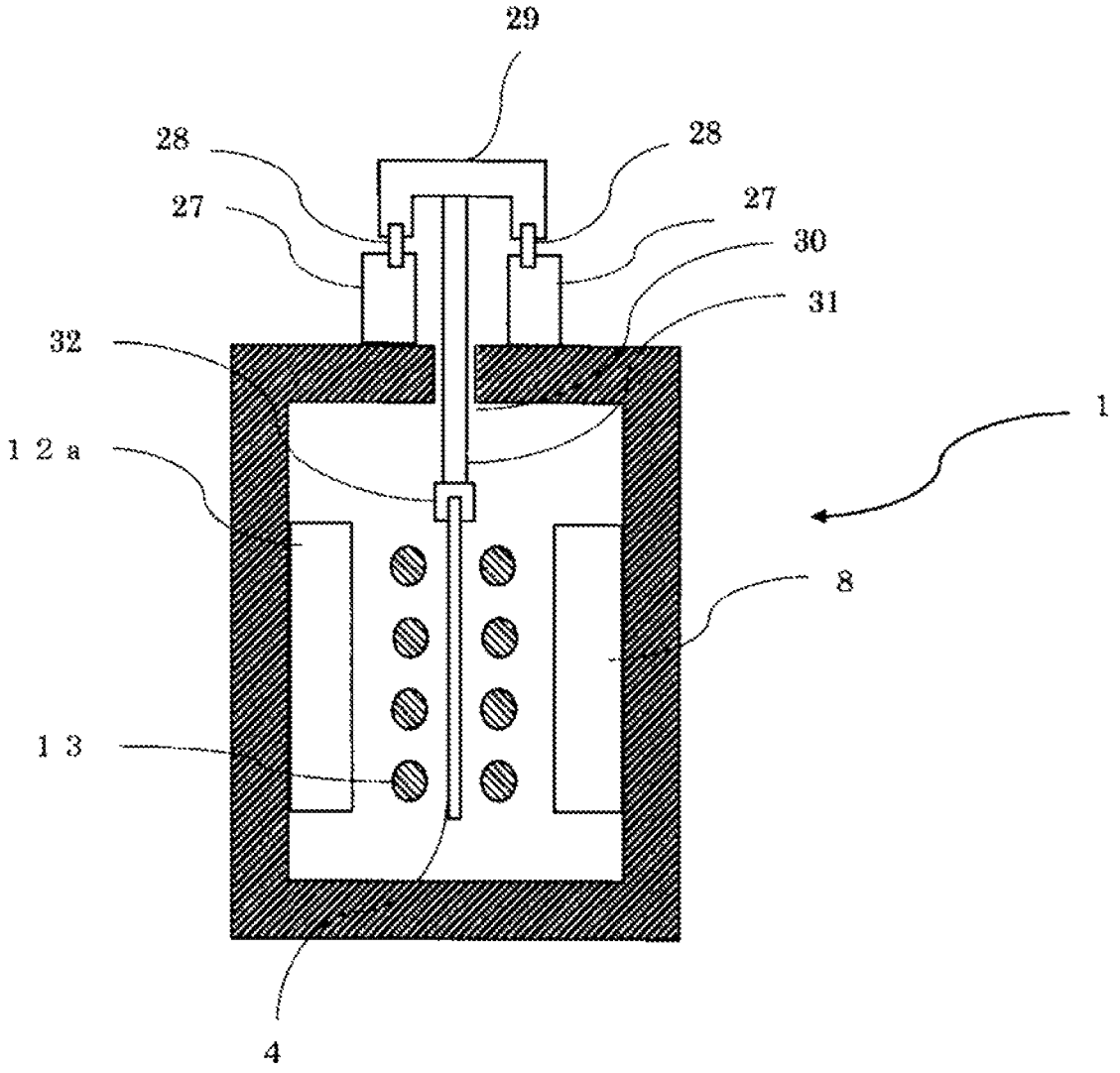
FIG. 8 is a front view of the ultrasonic bath of FIG. 2 when viewed from the Z direction.

A first configuration of the present invention will be described with reference to the drawings. FIG. 1 is a plan view of an ultrasonic treatment apparatus of an embodiment of the present invention when viewed from above. FIG. 2 is a side view of the ultrasonic treatment apparatus of FIG. 1 when viewed from the Y direction. FIG. 8 is a sectional front view of the ultrasonic treatment apparatus of FIG. 2 when viewed from the Z direction. Note that FIG. 1 and FIG. 2 do not show a conveyance mechanism of the treatment target object.

As shown in FIG. 1, the ultrasonic treatment apparatus is provided with, along a conveyance direction 5 of a treatment target object 4: a front bath 6; an ultrasonic bath 1; and a rear bath 7 in this order, and the treatment target object 4 passes through the baths in this order. Each of the baths is provided with a slit 30 constituting a path for a fixing part 31 shown in FIG. 8. In order to perform an ultrasonic treatment simultaneously on a plurality of treatment target objects in the ultrasonic bath 1, there is provided a plurality of ultrasonic vibrators.

Figure 9B:
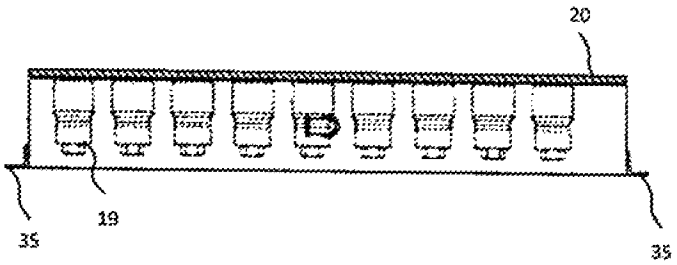
FIG. 9B is a sectional view of an ultrasonic vibrator when viewed from the bottom surface side (P direction)
Figure 9A:
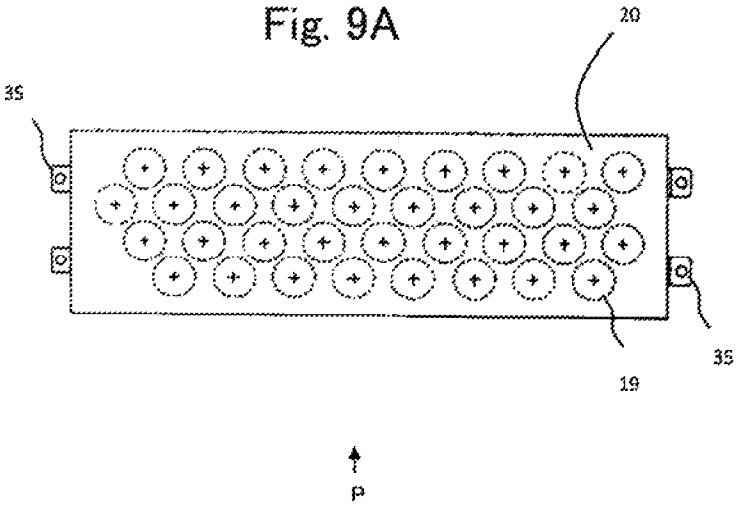
FIG. 9A is a front view of an ultrasonic vibrator when viewed from the treatment target object side.

The ultrasonic bath 1 is a treatment bath in which an ultrasonic treatment is performed on the treatment target objects 4, and the ultrasonic bath 1 has therein ultrasonic vibrators which transmit ultrasonic waves toward the treatment target objects 4. As shown in FIGS. 9A and 9B, the ultrasonic vibrator has a plurality of ultrasonic oscillators 19 and a plate member 20 provided in contact with the ultrasonic oscillation sides of the ultrasonic oscillators 19. The vibrations of the ultrasonic oscillators 19 make the plate member 20 vibrate, and the vibration of the ultrasonic wave thus propagates to the treatment liquid. Each of the ultrasonic vibrators is fixed on an inner wall of the ultrasonic bath 1 with fastening parts 35; however, the ultrasonic vibrators may be fixed on a fixed pillar such that the ultrasonic vibrator is not in contact with the inner wall.

As shown in FIG. 1, the ultrasonic bath 1 has a first ultrasonic vibrator 8 provided on the front surface side of the treatment target object 4 and a second ultrasonic vibrator 9 provided on the back surface side of the treatment target object 4. The first ultrasonic vibrator 8 and the second ultrasonic vibrator 9 are provided not to face each other. In the present invention, the expression "not to face" means that the ultrasonic oscillation surface of the ultrasonic vibrator provided on one side of the treatment target object is not located in front of the ultrasonic oscillation surface (the plate member 20 side) of the ultrasonic vibrator provided on the other side of the treatment target object, in other words, the ultrasonic oscillation surface of the ultrasonic vibrator provided on one side of the treatment target object is not located at the position of a front to which the ultrasonic oscillation surface of the ultrasonic vibrator provided on the other side of the treatment target object is opposed with the treatment target object 4 therebetween. With this arrangement, the resonance between the first ultrasonic vibrator 8 and the second ultrasonic vibrator 9 is prevented or reduced, and it is thus possible to prevent the ultrasonic vibrator, specifically the ultrasonic oscillators 19, from getting damaged. Here, in the present invention, the expressions "front surface" and "back surface" of the treatment target object 4 respectively mean the surface on one side and the surface on the other side, and, for example, in the case of a plate-shaped treatment target object, in one case, one of the surfaces having the largest area is a front surface, and the opposite side of that surface is a back surface; and in another case, one of the side surfaces is a front surface, and the side surface on the side opposite to that side surface (front surface) is a back surface.

With reference to FIG. 1, the ultrasonic bath 1 has: a third ultrasonic vibrator 10 provided on the front surface side of the treatment target object in the same manner as the first ultrasonic vibrator 8; and a fourth ultrasonic vibrator 11 provided on the back surface side of the treatment target object in the same manner as the second ultrasonic vibrator 9. If a plurality of ultrasonic vibrators are provided, the ultrasonic vibrators are disposed such that any of the ultrasonic vibrators (the first ultrasonic vibrator 8 and the third ultrasonic vibrator 10) provided on the front surface side does not face any of the ultrasonic vibrators (the second ultrasonic vibrator 9 and the fourth ultrasonic vibrator 11) provided on the back surface side. Note that regarding the number of the ultrasonic vibrators, arbitrary number of ultrasonic vibrators can be provided in accordance with the size of the ultrasonic bath and the like, and in that case, the ultrasonic vibrators are disposed not to face each other.

Figure 10:
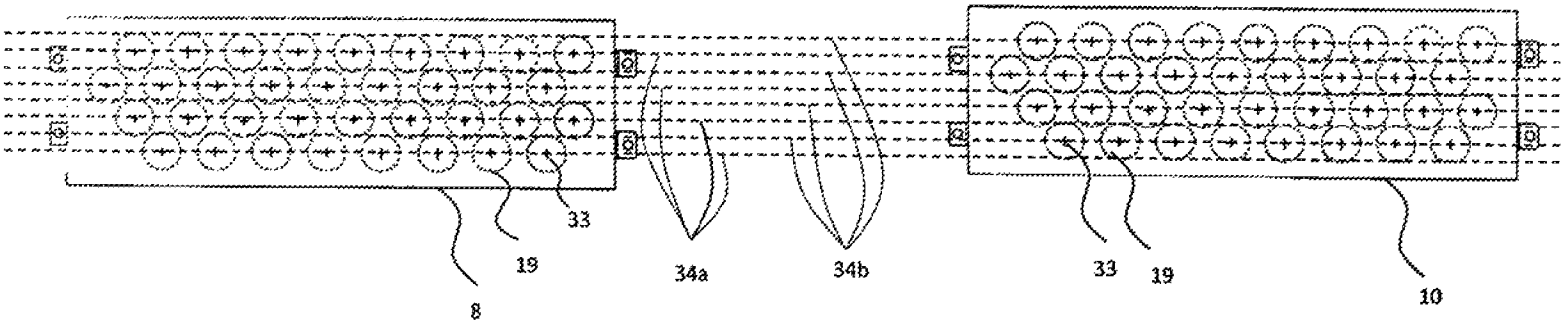
FIG. 10 shows an example of an installation state in the case that a plurality of ultrasonic vibrators are provided in the same surface side, and is a front view of the ultrasonic vibrators when viewed from the treatment target object side.
Figure 11C:
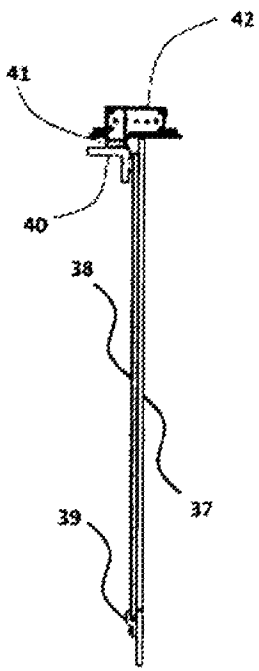
FIG. 11C is a side view of the open/close mechanism in an open state when viewed from the S1 direction.
Figure 11B:
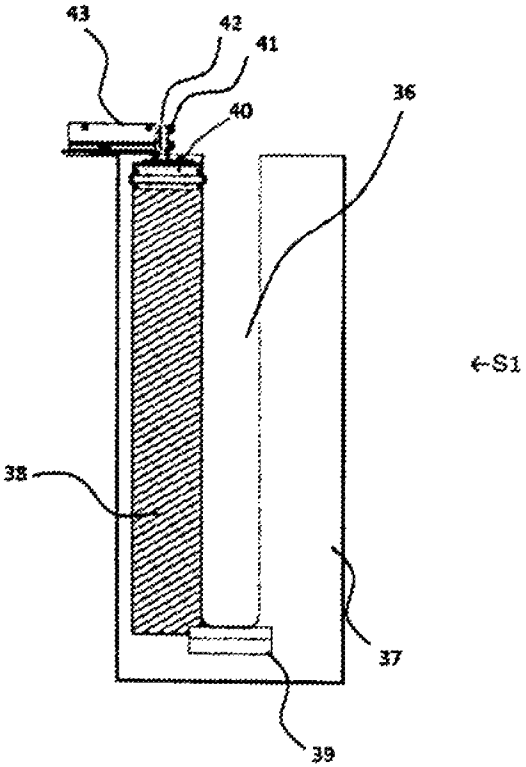
FIG. 11B is a front view of the open/close mechanism in an open state when viewed from the S direction.
Figure 11A:
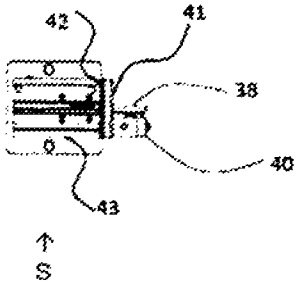
FIG. 11A is a plan view of the open/close mechanism of FIG. 1 in an open state when viewed from above.
Figure 12B:
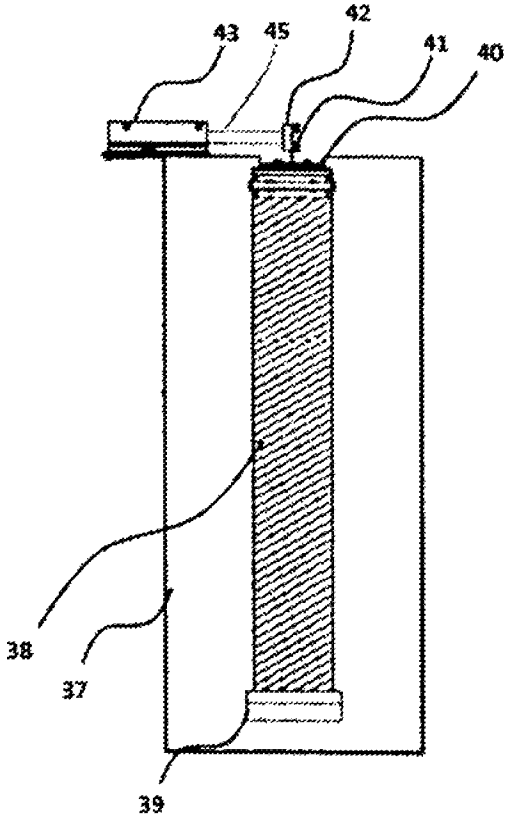
FIG. 12B is a front view of the open/close mechanism in a closed state when viewed from the S direction.
Figure 12A:
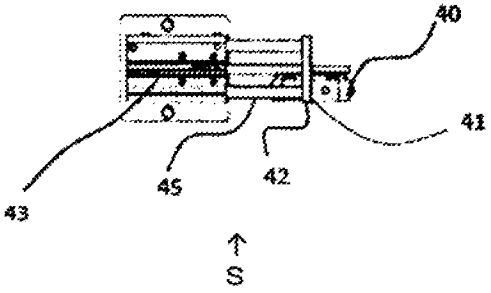
FIG. 12A is a plan view of the open/close mechanism of FIG. 1 in a closed state when viewed from above.
Figure 13B:
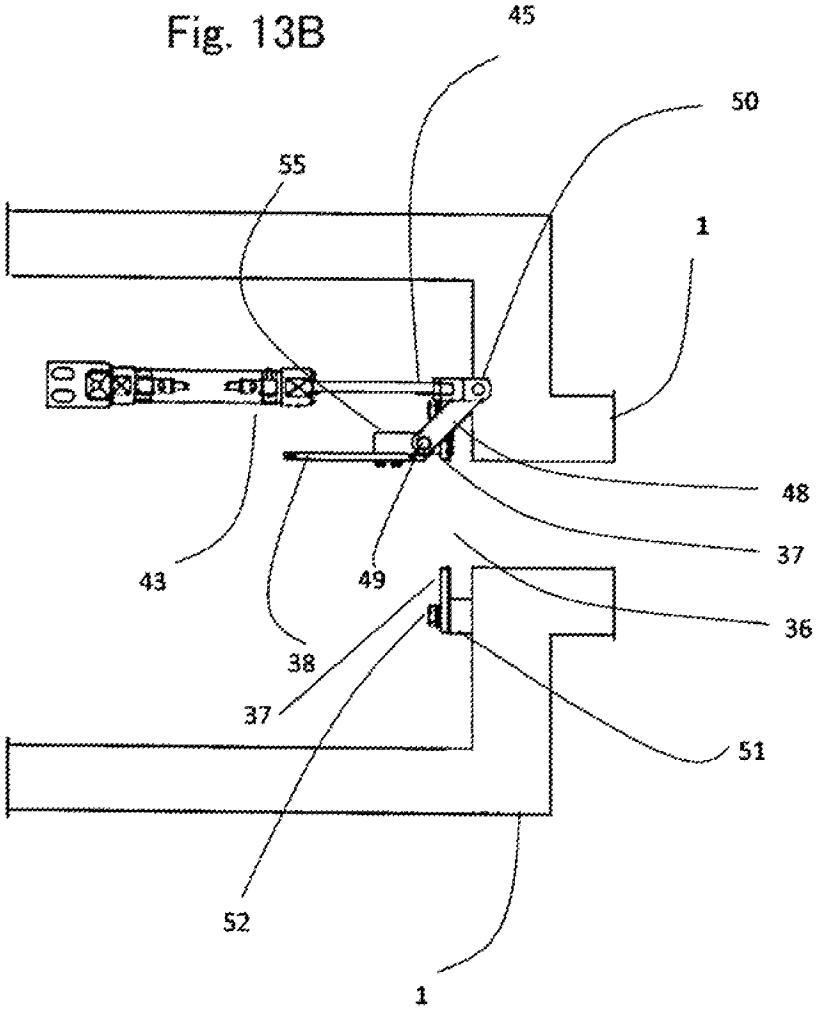
FIG. 13B is a plan view of the open/dose mechanism in an open state when viewed from above.
Figure 13A:
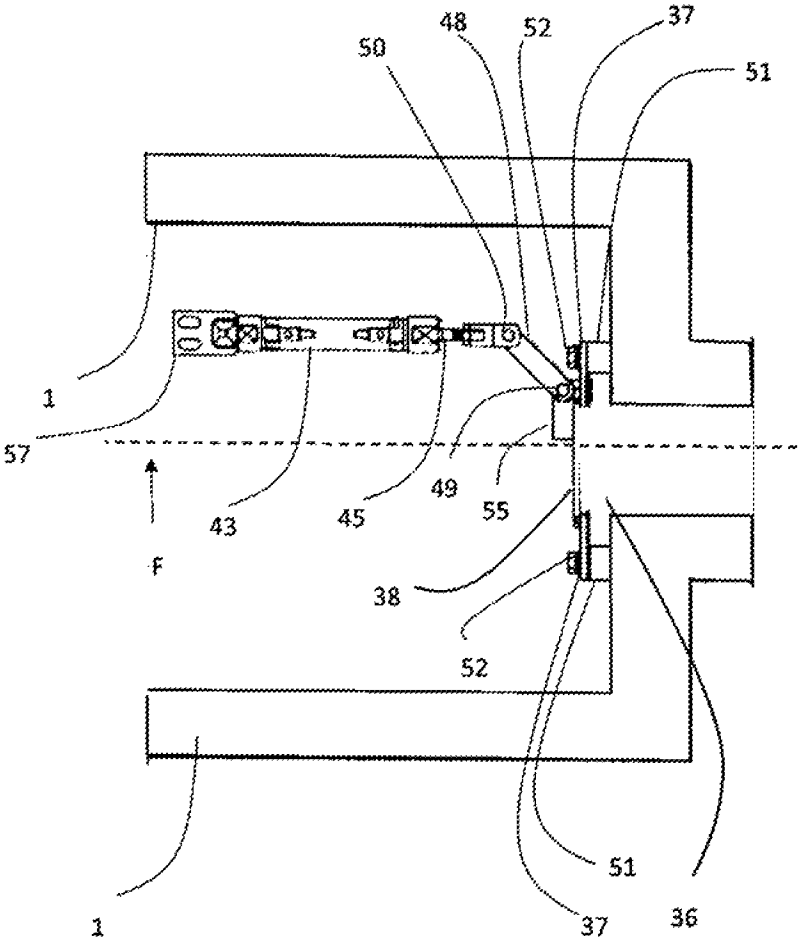
FIG. 13A is a plan view of the open/close mechanism of FIG. 1 in a closed state when viewed from above.
Figure 14B:
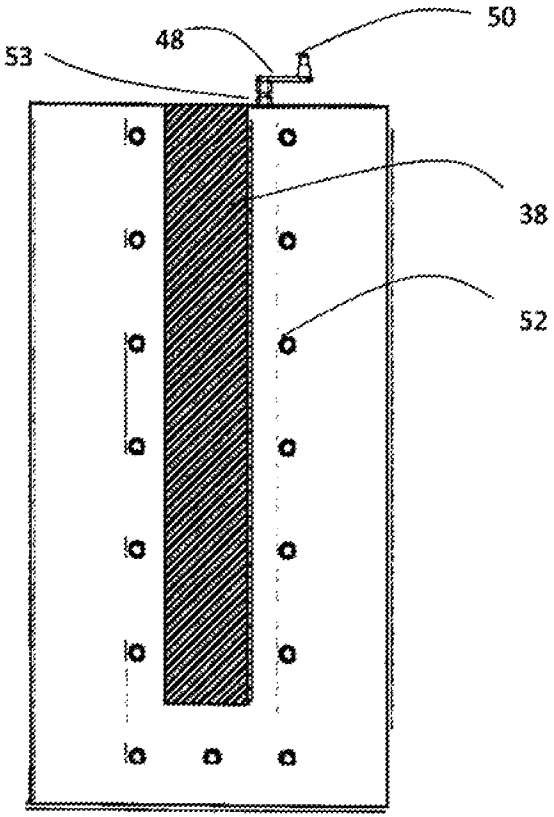
FIG. 14B is a front view of the open/close mechanism in a closed state when viewed from the T direction.
Figure 14A:
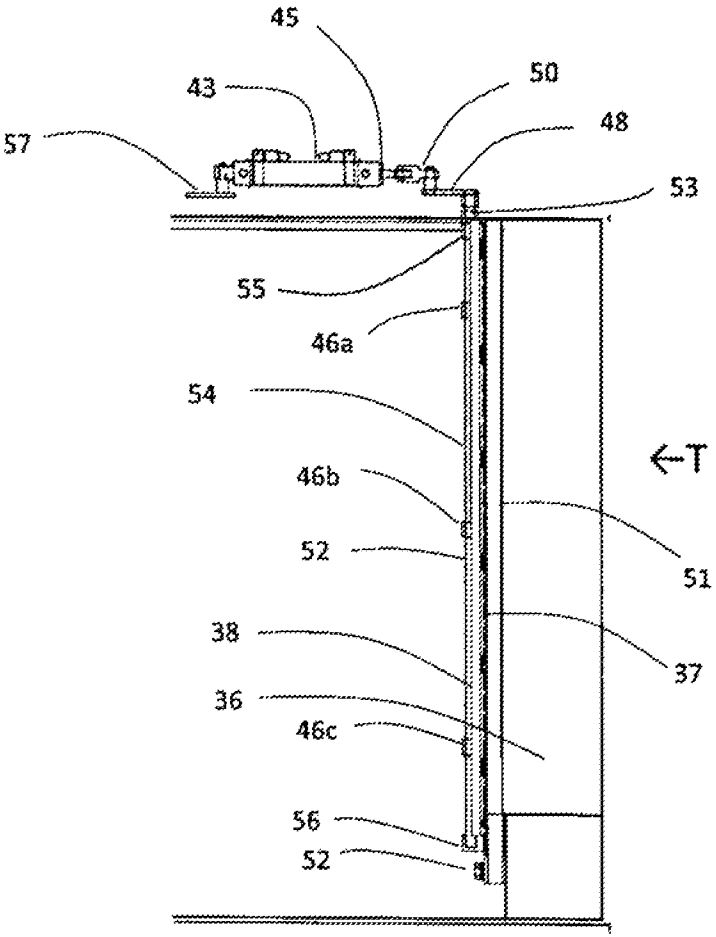
FIG. 14A is a side view of the open/close mechanism of FIG. 13A in a closed state when viewed from the F direction.

FIG. 10 is a side view showing an example of how a plurality of ultrasonic vibrators are disposed on the front surface side of the treatment target object 4. The ultrasonic vibrators are disposed such that any of the horizontal lines 34*a* passing through central parts 33 of the ultrasonic oscillators 19 (the central points of contact faces on which the ultrasonic oscillators are in contact with the plate member), which are arranged on the front surface side of the treatment target object 4 and constitute the first ultrasonic vibrator 8, does not overlap any of the horizontal lines 34*b* passing through central parts 33 of the ultrasonic oscillators 19 constituting the third ultrasonic vibrator 10. With this arrangement, the height positions of the ultrasonic oscillators 19, at which oscillation strengths are high, are different between the ultrasonic vibrators; therefore, the ultrasonic treatment is more uniformly performed on the treatment target object 4 being conveyed. Not shown in the drawings, similarly to the above, the second ultrasonic vibrator and the fourth ultrasonic vibrator both arranged on the back side of the treatment target object are also disposed such that any of the horizontal lines passing through the central parts of the ultrasonic oscillators constituting the second ultrasonic vibrator does not overlap any of the horizontal lines passing through the central parts of the ultrasonic oscillators constituting the fourth ultrasonic vibrator.

Further, the present invention includes reflectors facing the ultrasonic vibrators. The first ultrasonic vibrator 8 to the fourth ultrasonic vibrator 11 respectively have a reflector 12*a* to a reflector 12*d* which are provided to face the first ultrasonic vibrator 8 to the fourth ultrasonic vibrator 11 with the treatment target objects 4 therebetween. Note that the expression "to face the ultrasonic vibrator" means that the reflection surface of the reflector is located in front of the ultrasonic oscillation surface (the plate member 20) of the ultrasonic vibrator, in other words, the reflection surface of the reflector is located at the position of a front to which the ultrasonic oscillation surface of the ultrasonic vibrator is opposite with the treatment target object 4 therebetween. With this arrangement, the ultrasonic wave transmitted from the ultrasonic vibrator are reflected by the reflection surface of the reflector via the treatment target object, and the reflected ultrasonic wave (reflected wave) provides a surface treatment effect to the treatment target object. As the reflectors 12*a* to 12*d*, anything can be used if it has a property of reflecting an ultrasonic wave, and examples include a hollow container (empty box) and the like.

The ultrasonic treatment apparatus of the present invention includes: the front bath 6 provided on an entrance side of the ultrasonic bath 1; and the rear bath 7 provided on an exit side of the ultrasonic bath 1. Each of the front bath 6 and the rear bath 7 is provided with a treatment liquid supply unit and a treatment liquid removal unit. Not shown in the drawings, the treatment liquid supply unit is equipped with units necessary to supply treatment liquid, such as a supply pipe for the treatment liquid, a liquid feed pump for the treatment liquid, and a treatment liquid tank for storing the treatment liquid. With this arrangement, a predetermined amount of treatment liquid is supplied to the front bath 6 and the rear bath 7. Further, not shown in the drawings, the treatment liquid removal unit is equipped with a discharge port and a discharge port open/close unit on the bottom part of each of the front bath 6 and the rear bath 7. With this arrangement, the treatment liquid is discharged from the front bath 6 and the rear bath 7. As the discharge port open/close unit, various types of known discharge port open/close units can be employed, and examples include a sliding lid for opening and closing the discharge port. By opening and closing the sliding lid, the front bath 6 and the rear bath 7 can he controlled between a no-liquid state and a full-liquid state.

Further, each of the front bath 6 and the rear bath 7 is provided with ring rollers 17, and each rollers faces each of the front surface and the back surface of the treatment target object 4. By being conveyed between the feeing ring rollers 17, the posture of the treatment target object 4 is maintained.

Each of the exit and the entrance at the front and the back, in the conveyance direction, of each bath, there is equipped with each of open/close mechanisms 18*a* to 18*d*. One of the open/close mechanism is opened to let the treatment target object 4 pass through, and after the treatment target object 4 is conveyed into the next treatment bath, the open/close mechanism is closed. Each of the open/close mechanisms 18*a* to 18*d* is preferably configured to have: a fixed member having a slit (gate path) through which the treatment target object, for example, can pass; and a gate part which corresponds to the gate path and controls an open/close state.

A configurational example of the open/close mechanism 18*a* is shown in FIGS. 11A to 11C and FIGS. 12A and 12B.

The open/close mechanism 18*a* has a slit as a gate path 36 in a fixed member 37, and an L-shaped guide rail 39 is provided in the vicinity of the lower part of the fixed member 37. The fixed member 37 is fixed on an inner wall of the front bath 6 and is subjected to a sealing treatment so that treatment liquid does not leak through the fixed part. The L shape of the L-shaped guide rail 39 and the fixed member 37 form a recessed part as a guide groove, and a gate number 38 is slidingly disposed in the guide groove. The gate part has the gate member 38 and a cylinder member 43, and the gate member 38 and the cylinder member 43 are connected to each other through a connection part. With this arrangement, a reciprocal movement of the cylinder member 43 slides the gate member 38 along the guide groove, thereby performing control of opening and closing. In the example shown in the drawing, the connection part is configured such that an L-shaped fixed member 40 provided on the upper part of a gate member 38 and a T-shaped connection member 41 provided on an end part (rod end 42) of a piston rod 45 constituting the cylinder member 43 are fixed to each other. Further, the cylinder member 43 is fixed on the upper part of the front bath 6 or the rear bath 7. When air is supplied to the cylinder member 43 from a compressor (not shown), the piston rod 45 extends, and the gate member 38 thus slides and overlaps the gate path 36; therefore, the gate is closed, and when this state is kept, the closed state is maintained. On the other hand, when the air is removed from the cylinder member 43, the piston rod 45 retracts, and the gate member 38 slides by being pulled in the retracting direction of the piston rod 45; therefore, the overlap with the gate path 36 is eliminated, thereby opening the gate, and when this state is kept, the gate is kept open.

Regarding the open/close mechanism 18*a*, when the gate member 38 is disposed on the side of the front bath 6, the gate member 38 is pressed against the fixed member 37 by the liquid pressure of the treatment liquid stored in the front bath 6, and the airtightness is thus increased; therefore, it is possible to prevent or reduce leakage of the treatment liquid from the connection part between the gate member 38 and the fixed member 37. Further, when the treatment liquid in the front bath 6 is discharged, the liquid pressure is thus released; therefore, it is possible to reduce a driving force necessary to open or close the gate member 38. The open/close mechanism 18*d* also has a configuration similar to that of the open/close mechanism 18*a*. Also in the open/close mechanism 18*d*, it is possible to improve the airtightness and reduce the driving force when the gate member 38 is disposed on the side of the rear bath 7.

An example of the open/close mechanism 18*c* is shown in FIGS. 13A, 13B and FIGS. 14A and 14B. Note that a ceiling of the ultrasonic bath 1 is not shown. The open/close mechanism 18*b* also has a similar configuration.

Regarding each of the open/close mechanism 18*b* between the front bath 6 and the ultrasonic bath 1 and the open/close mechanism 18*c* between the rear bath 7 and the ultrasonic bath 1, the gate member 38 swings toward the side of the ultrasonic bath 1 to open and close the slit part which functions as the gate path 36 and is provided in the fixed member 37 fixed on the ultrasonic treatment bath 1, through a fixing base 51, with fastening members 52 such as bolts. In the vicinity of one side surface (vertical direction) of the gate member 38, there is provided a shaft 54 approximately vertically. The upper end of the shaft 54 is engaged to an upper bearing 55 provided in the vicinity of the upper end of the gate member 38, and the lower end of the shaft 54 is engaged to a lower bearing 56 provided in the vicinity of the lower end of the gate member. Further, in the shaft 54 there are incorporated a plurality of hinges 46*a* to 46*c*, where the blades on one side of the hinges 46*a* to 46*c* are fixed to the gate member 38, and the blades on the other side are fixed to the fixed member 37. The upper bearing 55 is fixedly connected, at a predetermined angle, to a crank lever thread part 49 on one end of a crank lever 48 through a bearing member 53 such as a set-collar (unmovable part). Further, a through hole provided in the other end of the crank lever 48 is connected, with an engagement pin 50, to a through hole provided in the part of the rod end 42 of a piston rod 45 constituting the cylinder member 43 fixed on the upper part of the ultrasonic bath 1 with a fastening part 57, and the angle, whose fulcrum is the engagement pin 50, between the crank lever 48 and the piston rod 45 can change corresponding to the extension and contraction of the cylinder (variable engagement part). To the cylinder member 43 is connected an air compressor (not shown), and when air is supplied to the cylinder member 43, the piston rod 45 extends, and the angle of the variable engagement part whose fulcrum is the engagement pin 50 is accordingly decreased, and at the same time, a force is applied, in the extension direction of the piston rod 45, to the upper bearing 55 to which the crank lever 48 is fixed, and this force rotates the gate member 38 to the side of the ultrasonic bath 1 by 90° around the shaft 54 as an axis, thereby opening the gate member 38. When this state is kept, the gate path 36 is kept open. When the air supplied to the cylinder member 43 is removed, the piston rod 45 accordingly retreats, and the angle of the variable engagement part whose fulcrum is the engagement pin 50 is increased, and at the same time, a force is applied to the upper bearing 55 in the retreat direction of the piston rod 45; thus, the gate member 38 is rotated around the shaft 54 as an axis and is brought in contact with the fixed member 37, thereby closing the gate member 38. The ultrasonic hath 1 is filled with the treatment liquid; therefore, when the front bath 6 or the rear bath 7 is not filled with liquid, the liquid pressure from the side of the ultrasonic bath 1 presses the gate member 38, and the airtightness is thus increased; therefore, leakage of the treatment liquid is prevented or reduced. Further, when the front bath 6 or the rear bath 7 is fully filled with liquid, there is no liquid pressure difference left, and the gate member 38 can be opened with a small force.

The ultrasonic treatment apparatus is equipped with: the fixing part 31 which conveys the treatment target object 4 which is held, for example, in such a manner that the side surface, of the ultrasonic treatment apparatus, parallel to the conveyance direction 5 is aligned with the front and back surfaces, of the treatment target object 4, having the largest area; and a conveyance mechanism which conveys the fixing part 31 into the bath.

The fixing part 31 holds the upper part (one side) of the treatment target object 4 by a gripping member 32 such as a clump. As shown in FIG. 8, the fixing part 31 is held in an airborne state in the bath from a fixing part connection base 29 through the slit 30. Note that since the fixing part 31 has only to be able to hold the treatment target object 4, various known fixing parts can be used, and for example, it is possible to use a known hanger which is usually used to convey printed circuit boards and the like. Examples of the treatment target object include various plate-like treatment target object such as a resin substrate, a glass substrate, a metal substrate, and a ceramic substrates. The treatment target object may be an object having low flexibility such as a rigid board or may be an object having high flexibility such as a flexible board. Further, the thickness of some millimeter to a sub-micron level can be treated in the case that the treatment target object has a plate shape.

The conveyance mechanism shown in FIG. 8 is configured with at least guide rails 27, the fixing part connection base 29, and conveying rollers 28, where the conveyance rollers 28 are attached on the bottom part of the fixing part connection base 29 to move on the guide rails 27, and the conveying rollers 28 are driven by a drive unit (not shown) such as a motor. The guide rails 27 are fixed on the upper part of the ultrasonic treatment apparatus. Note that as the conveyance mechanism, various known fixing part conveyance units can be used.

Figure 3:
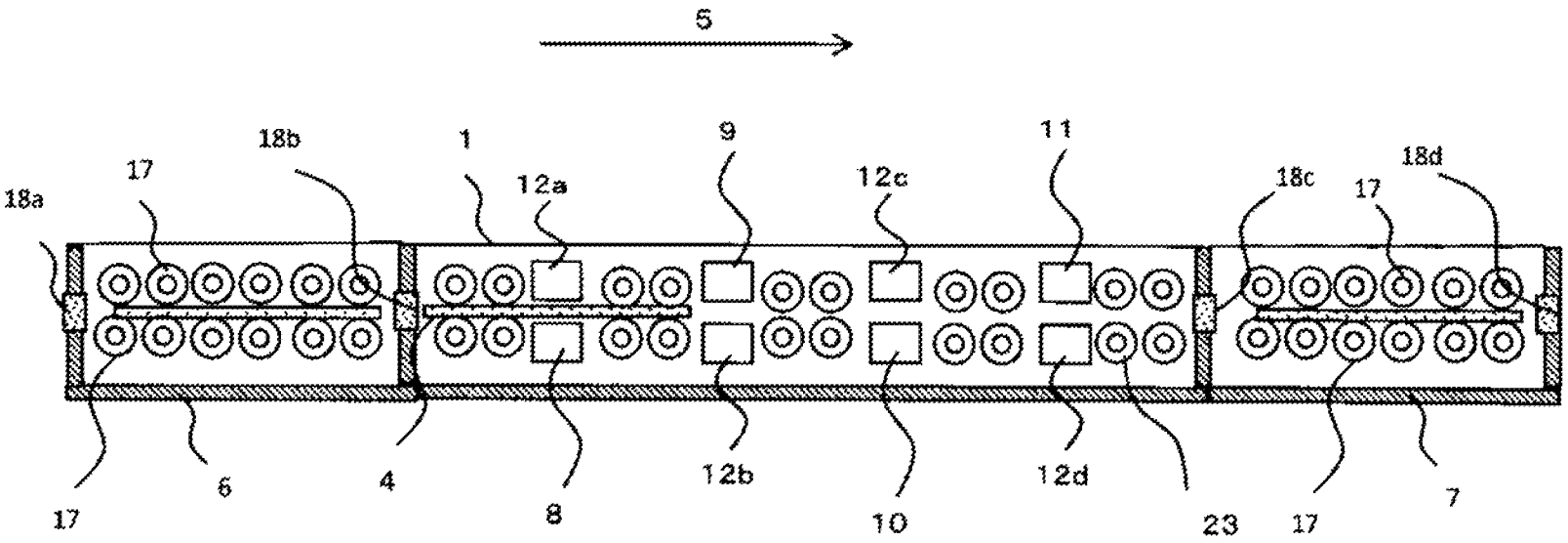
FIG. 3 shows another embodiment of the present invention and is a side view of an ultrasonic treatment apparatus in which a treatment target object is conveyed in a horizontal manner.

A description will be given to other embodiments of the ultrasonic treatment apparatus of the present invention in which the ultrasonic vibrators are disposed so as not to face each other. If the ultrasonic oscillation surface of one of the ultrasonic vibrators does not face the ultrasonic oscillation surfaces of the other ultrasonic vibrators with the treatment target object therebetween, there is no limitation to the direction of the flat surface of the treatment target object or the conveyance method of the treatment target object. FIG. 3 is a side view of an ultrasonic treatment apparatus which is another embodiment of the present invention and in which the treatment target objects 4 are conveyed in a horizontal manner in which the flat surfaces are directed to the vertical direction. There are respectively provided a front bath 6 and a rear bath 7 on the entrance side and the exit side of an ultrasonic bath 1 of FIG. 3, and open/close mechanisms are provided between the baths. In the ultrasonic bath 1, there are provided a plurality of conveyance rollers 23. The conveyance rollers 23 are disposed in a conveyance direction 5 at predetermined intervals, and between the conveyance rollers 23 on the upper side and the conveyance rollers 23 on the lower side, there is configured a treatment target object conveyance path in which the treatment target object 4 passes through in a horizontal posture. The conveyance rollers rotate at a constant speed by a drive device (not shown); thus, the treatment target object 4 is moved in the conveyance direction 5 between the upper and lower conveyance rollers. Further, on the side of the lower conveyance rollers 23, there is provided a first ultrasonic vibrator 8 to transmit an ultrasonic wave toward the front surface of the treatment target object 4, and a reflector 12*a* is disposed to face the first ultrasonic vibrator 8 with the treatment target object 4 therebetween. Further, there is provided along the conveyance direction 5 a second ultrasonic vibrator 9 which transmits an ultrasonic wave toward the back surface of the treatment target object 4, and a reflector 12*b* is disposed to face the second ultrasonic vibrator 9 with the treatment target object 4 therebetween. The first ultrasonic vibrator 8 and the second ultrasonic vibrator 9 are disposed not to face each other. Regarding a third ultrasonic vibrator 10 and a fourth ultrasonic vibrator 11, similarly to the first ultrasonic vibrator 8 and the second ultrasonic vibrator 9, there are disposed reflectors 12*c* and 12*d* respectively facing the third ultrasonic vibrator 10 and the fourth ultrasonic vibrator 11, and each of the ultrasonic vibrators is disposed not to face the other ultrasonic vibrator.

Further, each of the ultrasonic vibrators has a configuration shown in FIGS. 9A and 9B, and the horizontal lines 34 passing through central parts 33 of ultrasonic oscillators 19, which are arranged on the lower surface side of the treatment target object 4 and constitute the first ultrasonic vibrator 8, is shifted in the depth direction (the direction perpendicular to the paper surface of the drawing) so that any of the horizontal lines 34 passing through the central parts 33 of the ultrasonic oscillators 19 does not overlap any of the horizontal lines 34 passing through central parts 33 of ultrasonic oscillators 19 constituting the third ultrasonic vibrator 10. Similarly to the above, the ultrasonic oscillators of the second ultrasonic vibrator 9 and the fourth ultrasonic vibrator 11 arranged on the upper surface side of the treatment target object 4 are disposed to be sifted in the depth direction so that none of the horizontal lines do not overlap each other.

Note that each of the front bath 6 and the rear bath 7 is provided with ring rollers 17 similarly to the conveyance rollers 23 so as to be able to convey the treatment target object 4 in a horizontal manner and is so configured that the treatment target object 4 can be moved between the ring rollers 17 provided on the upper and lower sides. The front bath 8 in FIG. 2 and the rear bath 7 in FIG. 3 are different such that the treatment target objects 4 in the front bath 6 and the rear bath 7 respectively are in a vertical state and a horizontal state; however, the front bath 6 and the rear bath 7 have the other structural components such as the treatment liquid supply units and the treatment liquid removal units in the same way.

Figure 4:
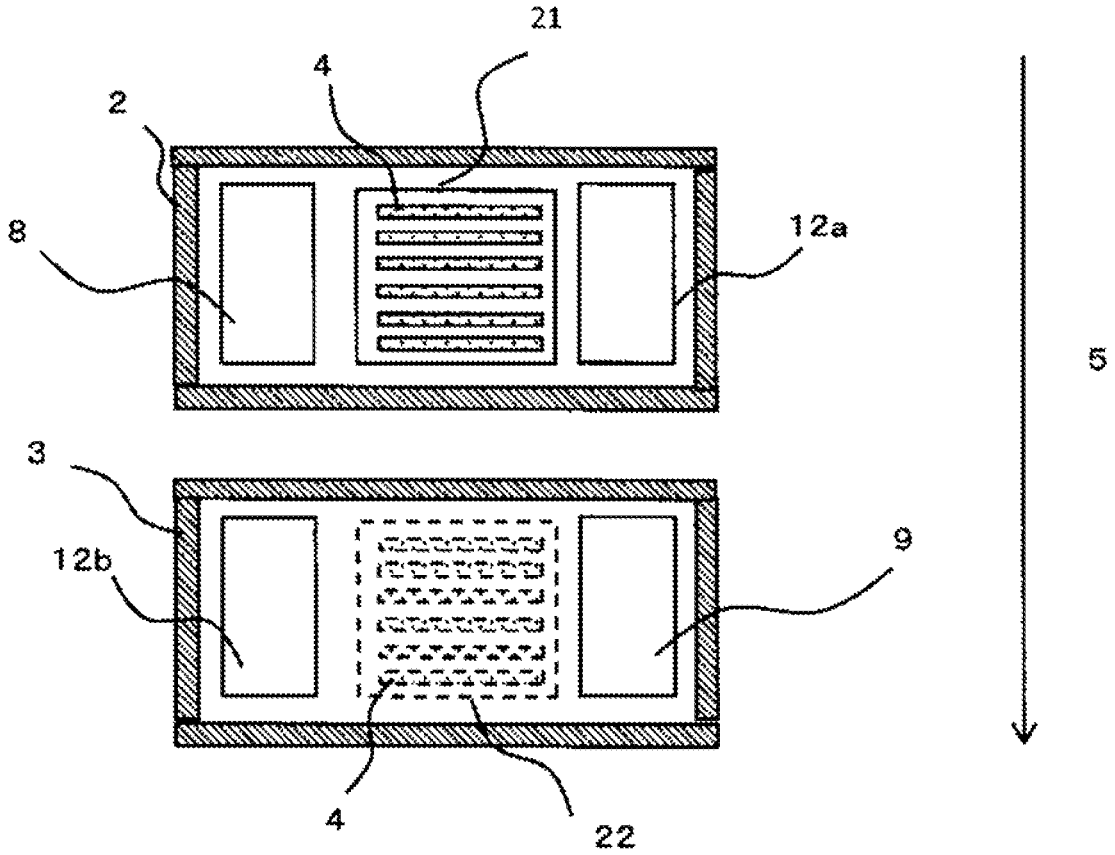
FIG. 4 shows another embodiment of the present invention and is a plan view, viewed from above, of an ultrasonic treatment apparatus in which a treatment target object is conveyed in a basket.

FIG. 4 is a plan view, viewed from above, of an ultrasonic treatment apparatus which is still another embodiment of the present invention and conveys the treatment target objects by using a basket. The ultrasonic treatment apparatus of FIG. 4 is configured with a first ultrasonic bath 2 and a second ultrasonic bath 3. The first ultrasonic bath 2 is provided with a first ultrasonic vibrator 8 which radiates an ultrasonic wave from the side surface direction of the treatment target objects, and a reflector 12*a* is disposed to face the first ultrasonic vibrator 8 with the treatment target objects 4 therebetween. Further, similarly to the first ultrasonic bath 2, on the second ultrasonic bath 3, there are disposed a second ultrasonic vibrator 9 and a reflector 12*b*. A basket 21 is configured with a frame member forming side surfaces so as to form a space therein and has a bottom part. In the inner space of the basket 21, the treatment target objects 4 are arranged in line in the thickness direction. The treatment target objects 4 are held by the bottom part of the basket 21 and a holding part (not shown) provided on the frame member so that the treatment target objects 4 do not incline. After being subjected to an ultrasonic treatment in the first ultrasonic bath 2, the basket 21 is lifted by a conveyance mechanism (not shown) to be taken out from the first ultrasonic bath 2 and is moved. The basket 21 is then conveyed into the second ultrasonic hath 3 by being lowered to a basket conveyance position 22 of the second ultrasonic bath 3 and is subjected to an ultrasonic treatment. When the first ultrasonic bath 2 and the second ultrasonic bath 3 are combined, the first ultrasonic vibrator 8 and the second ultrasonic vibrator 9 transmit ultrasonic waves from different directions via the treatment target objects 4; however, the first ultrasonic vibrator 8 and the second ultrasonic vibrator 9 are provided in the different ultrasonic baths, which means that the first ultrasonic vibrator 8 and the second ultrasonic vibrator 9 are disposed so as not to face each other.

Figure 5:
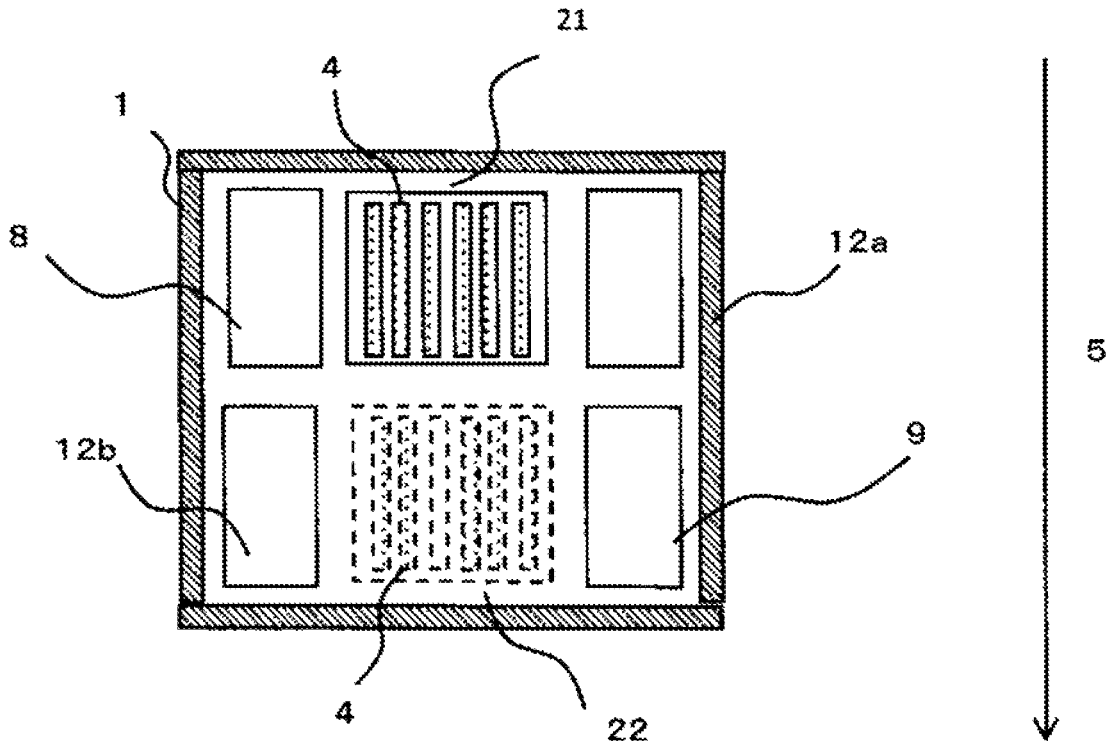
FIG. 5 shows another embodiment of the present invention and is a plan view, viewed from above, of an ultrasonic treatment apparatus in which a treatment target object is conveyed in a basket.

FIG. 5 is a plan view, viewed from above, of an ultrasonic treatment apparatus which is another embodiment of the present invention and in which the treatment target objects are conveyed in a basket. The ultrasonic bath 1 is provided with a first ultrasonic vibrator 8 which transmits an ultrasonic wave from the front surface direction of the treatment target objects, and a reflector 12*a* is disposed to face the first ultrasonic vibrator 8 with the treatment target objects 4 therebetween. Further, the ultrasonic bath 1 is provided with a second ultrasonic vibrator 9 which transmits an ultrasonic wave from the back surface direction of the treatment target objects, and a reflector 12*b* is provided to face the second ultrasonic vibrator 9 with the treatment target objects 4 therebetween. The second ultrasonic vibrator 9 and the first ultrasonic vibrator 8 are provided so as not to face each other. A basket 21 is configured similarly to FIG. 4, and the treatment target objects 4 are similarly held. After being subjected to an ultrasonic treatment on the side of the first ultrasonic vibrator 8, the basket 21 is conveyed to the basket conveyance position 22 by a conveyance mechanism (not shown), and the basket 21 is subjected to an ultrasonic treatment on the side of the second ultrasonic vibrator 9.

Figure 6A:
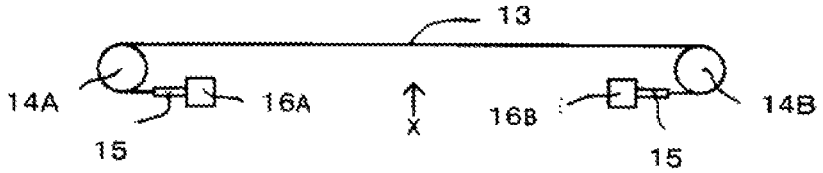
FIG. 6A is a plan view of a guide member when viewed from above.
Figure 6B:
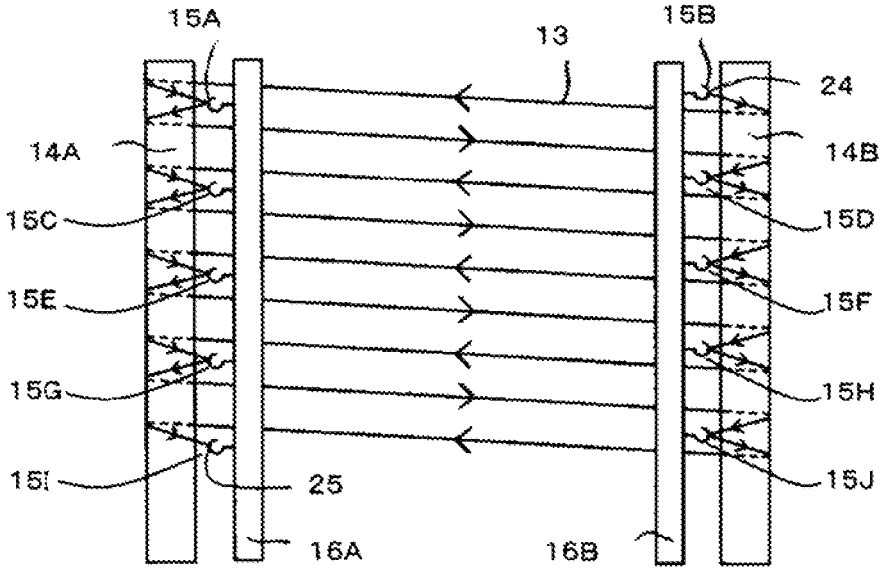
FIG. 6B is a side view of a guide member when viewed from the X direction.

Next, a second configuration of the present invention will be described. An ultrasonic bath 1 is configured as shown in FIG. 1, and the same components as in the above first configuration are not described again. The ultrasonic bath 1 has a guide member facing the front surface of the treatment target object 4 and a guide member facing the back surface of the treatment target object 4. FIG. 6A is a plan view, viewed from above, of one of the guide members provided in the ultrasonic bath 1 shown in FIG. 1, and FIG. 6B is a side view, viewed from the X direction, of the guide member. The guide member on the opposite side has the same configuration and is not described again.

The guide member is configured with wire members 13. The wire members 13 have a far smaller area than the ring roller 17 or the like and do not interfere with the ultrasonic wave. The guide member is configured with a plurality of wire members 13 disposed on a vertical plane. Since the wire members 13 are disposed on the vertical plane, it is possible to prevent or reduce wobble of the treatment target objects 4 and diffused reflection of the ultrasonic wave. Further, the wire members 13 are provided such that a longitudinal direction of each of the wire members 13 is inclined with respect to the horizontal line. With this arrangement, along with the movement of the treatment target object, the height positions, on the treatment target object 4, facing the wire members 18 change. As a result, non-uniformity of irradiation of the ultrasonic wave is eliminated in the height, direction of the treatment target object 4, thereby improving an ultrasonic treatment effect. The inclination directions of the wire members 13 are not particularly limited.

The guide member shown in FIG. 6B has, on the both ends in the longitudinal directions of the wire members 13: a support pillar 14A and a support pillar 14B for holding the wire members; and folding parts 15A to 15J at which the wire members 13 are folded and which are provided close to the support pillar 14A and the support pillar 14B. The end parts of each of the support pillar 14A and the support pillar 14B are in contact with the bottom surface and the ceiling surface of the ultrasonic bath 1 so that the support pillar 14A and the support pillar 14B can stay in an approximately vertical posture. In the vicinity of the support pillars 14 A and 14B, there are respectively disposed a fixed pillar 16A and a fixed pillar 16B, which are fixed parallel to the support pillar. The fixed pillar 16A is provided with folding parts 15A, 15C, 15E, 15G, and 15I, the fixed pillar 16B is provided with folding parts 15B, 15D, 15F, 15H, and 15J, and the folding parts are at different height positions. Examples of the folding parts 15A to 15J include metal hooks or the like. The wire member 13 connected to the folding part 15B, which is provided on the fixed pillar 16B and functions as a starting point 24, is looped around the outer circumference of the support pillar 14B from the wall surface side of the ultrasonic bath 1, is passed through the side of the treatment target object 4, is stretched to the other support pillar 14A, is looped around the outer circumference of the support pillar 14A from the side of the treatment target objects 4, and is passed through the folding part 15A provided on the fixed pillar 16A. Then, the wire member 13 is folded at the folding part 15A, is looped around the outer circumference of the support pillar 14A from the wall surface side of the ultrasonic bath 1, is passed through the side of the treatment target object 4, and is stretched to the side of the support pillar 14B. The wire member 13 is looped around the outer circumference of the support pillar 14B from the side of the treatment target objects 4, is folded at the folding part 15D, is looped around the outer circumference of the support pillar 14B in a similar manner, is passed through the treatment target object side, and is stretched to the side of the support pillar 14A. The wire member 13 is, in a similar manner, folded at the folding parts 15E, 15H, 15G, 15J, and up to 15I in this order and is connected to the folding part 15I, which is a finishing point 25. With this arrangement, the wire members 13 are disposed on the vertical plane on the treatment target object 4 side of the support pillar 14A and the support pillar 14B. Further, since the guide member is formed of a single wire, it is easy to produce and maintain the guide member.

Figure 7:
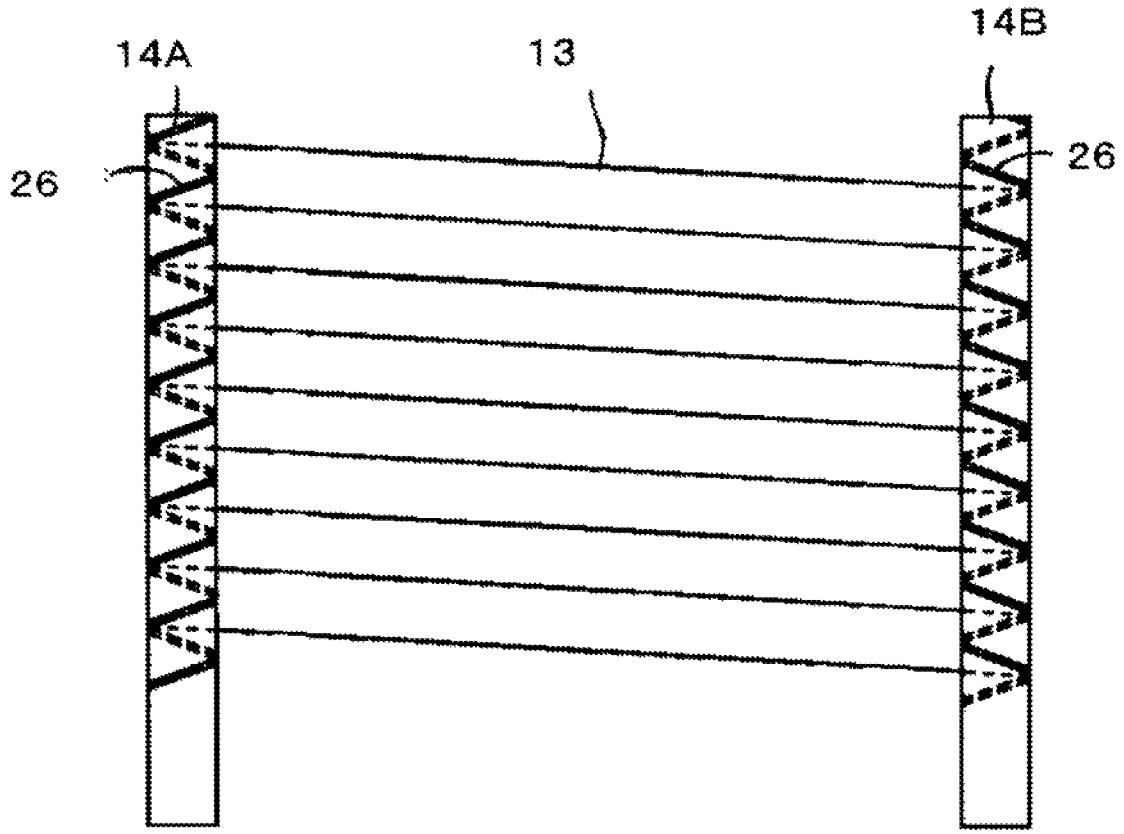
FIG. 7 is a side view of a guide member of the present invention when viewed from the X direction in FIG. 6A.
Figure 15B:
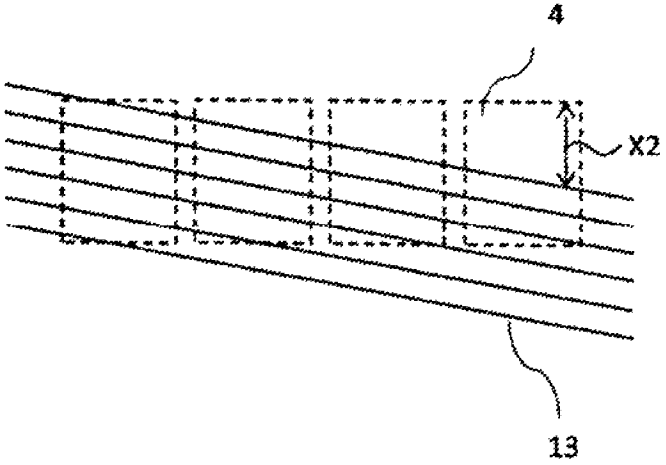
FIG. 15B is a diagram, viewed from the Y direction in FIG. 1, showing the state after the height positions of the wire members on the side of the one of the support pillars are lowered.
Figure 15A:
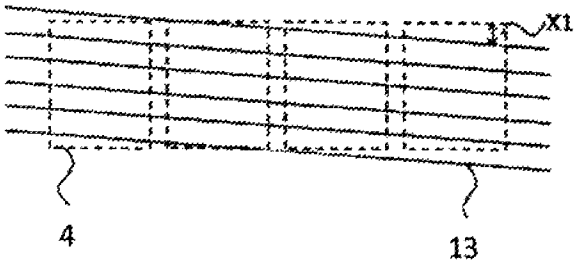
FIG. 15A is a diagram, viewed from the Y direction in FIG. 1, showing the state before height positions of the wire members of the guide member on the side of one of the support pillars are lowered.

FIG. 7 is a drawing of a preferred embodiment of the support pillars 14A and 14B used in FIGS. 6A and 6B, and the fixed pillars 16A and 16B are omitted in the drawing. As shown in FIG. 7, in each of the support pillars 14A and 14B shown in FIGS. 6A and 6B, a continuous spiral groove 26 is preferably provided from the upper side to the lower side of the support pillar. In each of the support pillars 14A and 14B, the groove 26 is so formed that the wire member 13 can be disposed in the groove 26. The wire member 13 is looped around the outer circumference of the support pillar 14A along the groove 26 of the support pillar 14A and is stretched to the folding part and the support pillar 14B. The wire member 13 is similarly handled also on the support pillar 14B and is stretched to the folding part and the support pillar 14A. Likelihood of warp or bend of the treatment target object 4 depends on the size (in particular, thickness) and the material of the treatment target objects 4. Therefore, by providing a groove to the support pillars 14A and 14B as shown in FIG. 7 and disposing the support pillars 14A and 14B to be rotatable around the vertical axes thereof, it is possible to change the inclination angles or the height positions of the wire members 13 to the position effective to prevent the bend and warp of the treatment target object 4. That is, when the support pillar is rotated around the vertical axis thereof, the wire members 13 move on the support pillar along with the rotation of the groove 26 to change the height positions of thereof, and as a result, the inclination angles of the wire members 13 can be changed. For example, if the support pillar 14B is rotated around the vertical axis, the heights of the wire members 13 on the support pillar 14B side are lowered along the groove 26, and as shown in FIGS. 15A and 15B, the inclination angles of the wire members 13 in the longitudinal direction are changed with respect to the horizontal line; thus, the height positions of the wire members 13 become lower than the upper surfaces of the treatment target objects 4 (from X1 to X2). Further, if the support pillar 14B is rotated in the reverse direction, the height positions of the wire members 13 can be raised (from X2 to X1). Similarly, by rotating the support pillar 14A around the vertical axis thereof, the height positions of the wire members 13 on the support pillar 14A side can be changed. If the support pillar 14A and the support pillar 14B are rotated in the same direction, the height positions of the wire members 13 can be changed while keeping the inclination angles. Note that the groove 26 has only to ho formed in at least one of the support pillars 14A and 14B; however, it is desirable that the groove 26 be formed in both of the support pillars 14A and 14B. Further, the rotation unit for the support pillar is not particularly limited, and for example, a rotation base, a drive unit for the rotation base, and a rotation controller may be provided on the bottom surface of a base for the ultrasonic bath 1 or on the ceiling of the ultrasonic bath 1, and the upper end part or the lower end part of the support pillar may be connected to the rotation base. By transferring an instruction of operation from the controller to the drive unit such as a motor, the rotation base is operated, and the support pillar can be thus rotated.

Example of the wire member 13 include a metal wire, a resin wire, and the like. In particular, in the case that a wire member such as a metal wire having conductivity is used, if the wire member 13 is electrically connected to a power supply and an energization detection device and is constantly energized, the energization detection device can detect when the wire member 13 is broken, and the wire member 18 can be quickly repaired. Note that in order to prevent or reduce damage of the treatment target object 4 caused by contact of the wire member 13, a metal wire covered with a resin or the like may be used.

Next, a surface treatment using an ultrasonic treatment apparatus will be described with reference to FIGS. 1, 2, and 8. The treatment target object 4 is previously attached in a vertically hanging state (the state in which both surfaces are vertical) such that the upper part of the treatment target object 4 are held by the gripping member 32 of the fixing part 31 of a conveyance unit. When the ultrasonic treatment apparatus is activated, the open/close mechanism 18*a* is first opened. After the treatment target object 4 is conveyed into the front bath 6 by the conveyance mechanism, the open/close mechanism 18*a* is closed.

Each of the open/close mechanisms 18*a* to 18*d* provided in the baths is controlled, being electrically connected to the controller (not shown), and when an instruction of operation is received from the controller, the piston rod 45 of the cylinder member 43 extends. Due to the extension of the piston rod 45, the gate member 38 moves to open the gate path 36, and the treatment target object 4 is then conveyed in. After the treatment target object 4 passes through, the extended piston rod 45 retracts upon receiving an instruction of operation from the controller. Due to the contraction of the piston rod 45, the gate member 38 moves to close the gate path 36, and the baths are separated to make independent spaces.

In the present invention, the controller is equipped with: a CPU which performs various arithmetic processing operations; a memory (RAM, ROM) which stores programs and from which programs are read out; and a recording medium (magnetic disk or the like) for a control program, data, and the like, where various programs stored in the recording medium are read out in the memory, and the CPU controls operations and processes of respective parts of the ultrasonic treatment apparatus. Note that the devices which need to be supplied with electricity to operate are connected to a power supply (not shown), and the power supply supplies necessary electric power.

Further, the conveyance mechanism for the treatment target object 4 is controlled with the motor and the controller (not shown) being electrically connected to each other, and the conveying rollers 28 rotates, being driven by the motor receiving an instruction from the controller, so that the conveyance mechanism moves on the guide rail 27 to a predetermined position. This operation moves the treatment target object 4 held by the fixing part 31 of the conveyance mechanism.

The treatment target object 4 is conveyed into the front bath 6 and stops at the predetermined position, and then the same treatment liquid as for the ultrasonic bath 1 is supplied. Specifically, a supply pump is pressurized when receiving an instruction of operation from the control unit, so that the treatment liquid is supplied to the front bath 6 from a liquid storage tank through a treatment liquid supply pipe. The supply amount of the treatment liquid is controlled by using a detection unit such as a sensor (not shown), and when it is detected that the treatment liquid reaches the same liquid surface level as in the ultrasonic bath 1, a signal is transmitted to the controller, so that the supply of the treatment liquid is stopped. This operation makes the front bath fully filled with liquid.

After the front bath 6 is fully filled with liquid, the open/close mechanism 18*b* is opened, and the treatment target object 4 is conveyed by the conveyance mechanism into the ultrasonic bath 1 which is filled with the treatment liquid. Alter the treatment target object 4 is conveyed into the ultrasonic bath 1, the gate is closed, thereby closing the open/close mechanism 18*b*. Since the treatment target object 4 is conveyed into the ultrasonic bath 1 after being immersed in the treatment liquid in the front bath 6, even if the open/close mechanism 18*b* is opened, flow of the treatment liquid is reduced, and damage such as bend of the treatment target object 4 caused by wobble can be reduced.

After the open/close mechanism 18*b* is closed, the treatment liquid filling the front bath 6 is discharged. Specifically, when the discharge port open/close unit is opened by the control unit, the treatment liquid in the front bath 6 is discharged through a discharge pipe connected to the discharge port. This operation puts the inside of the front bath 6 in a no-liquid state. The discharged treatment liquid may be discarded or may be reused after being subjected to an appropriate treatment such as filtering out of foreign substances. After the treatment liquid is discharged, the discharge port is closed. After the front bath 8 is put in a no-liquid state, the open/close mechanism 18*a* is opened, and the next treatment target object 4 is conveyed in.

The treatment target object 4 conveyed into the ultrasonic bath 1 is moved by the conveyance mechanism toward the open/close mechanism 18C at a constant speed. The ultrasonic vibration transmitted from the first to fourth ultrasonic vibrators 8 to 11 provided in the ultrasonic bath 1 propagates in the treatment liquid and is then applied to the moving treatment target object 4, thereby removing foreign substances and the like attached to the surfaces of the treatment target object 4. As the treatment liquid, various known ultrasonic treatment liquids can be used such as water or water added with a surface-active agent. A specific operation of the ultrasonic vibrator will be described later.

The treatment liquid in the ultrasonic bath 1 is drawn out from the discharge port, and after foreign substances in the treatment liquid are removed by a clarification facility such as a filter, the treatment liquid is supplied into the ultrasonic bath 1 from a supply port, (not shown). By this operation, the ultrasonic treatment can be performed while keeping cleanliness of the treatment liquid in the ultrasonic bath 1. A liquid surface level of the treatment liquid in the ultrasonic treatment bath 1 is kept constant by controlling the supply amount and the discharge among of the treatment liquid.

When the treatment target object 4 is reaching the open/close mechanism 18*c*, the gate member 38 swings to open the open/close mechanism 18*c*, and the treatment target object 4 is conveyed into the rear bath 7 filled with treatment liquid. The rear bath 7 is previously supplied with liquid to be in a full-liquid state, and the treatment target object 4 moves, in the liquid, from the ultrasonic bath 1 to the rear bath 7. After the treatment target object 4 is conveyed into the rear bath 7, the open/close mechanism 18*c* is closed. The treatment target object 4 conveyed into the rear bath 7 stops at a predetermined position. The treatment liquid is supplied to the rear bath 7 in the same manner as in the case of the front bath 6, and the description is skipped. Since the rear bath 7 is previously fully filled with liquid, the treatment target object 4 moves in the liquid and is conveyed out from the ultrasonic bath 1; therefore, even if the open/close mechanism 18*c* is opened, flow of the treatment liquid is reduced, and damage such as bend of the treatment target object 4 caused by wobble can be also reduced.

After the open/close mechanism 18*c* is closed, the treatment liquid filling the rear bath 7 is discharged. The treatment liquid in the rear bath 7 is discharged in the same manner as in the case of the front bath 6, and the description is skipped. After the inside of the rear bath 7 becomes in a no-liquid state, the open/close mechanism 18*d* is opened, and the treatment target object 4 is conveyed out from the rear bath 7. After the treatment target object 4 is conveyed out, the open/close mechanism 18*d* is closed. After that, the rear bath 7 is supplied with treatment liquid to be in a full-liquid state.

Next, the ultrasonic vibrators provided in the ultrasonic bath 1 will be described. Each of the ultrasonic vibrators is equipped with an ultrasonic oscillation unit (not shown) to drive the ultrasonic oscillators. The ultrasonic oscillation unit is electrically connected to a power supply (not shown) and the controller, and oscillates an ultrasonic wave at predetermined intervals and a predetermined frequency upon receiving an instruction of operation from the controller. The ultrasonic vibrator may be constantly operated or may be controlled on and off.

A constant oscillation at the same frequency creates a standing wave, and there may be created an ultrasonic treatment non-uniformity on the treatment target object or damage to the treatment target object. In order to solve the above problems, some measures can be considered as follows: (a) the ultrasonic vibrator is configured with a plurality of ultrasonic oscillators which oscillate ultrasonic waves of different frequencies; (b) the ultrasonic vibrator is made to oscillate at two or more frequencies at the same time; and c) the ultrasonic vibrator oscillates at a variable frequency, where any of the measures can be used alone or in combination.

(a) Ultrasonic Oscillators of Different Frequencies

The ultrasonic vibrator may be configured with a plurality of ultrasonic oscillators which oscillate ultrasonic waves of different frequencies. This arrangement can prevent or reduce an ultrasonic treatment non-uniformity and damage to the treatment target object which are caused when an ultrasonic wave of the same frequency is kept being applied to the same place on the treatment target object. The plurality of ultrasonic oscillators can be a combination of two or more ultrasonic oscillators of different frequencies. Examples of a combination of ultrasonic oscillators of two kinds of frequencies include: an ultrasonic vibrator in which an ultrasonic oscillator of a frequency of 40 kHz and an ultrasonic oscillator of a frequency of 75 kHz are combined; and an ultrasonic vibrator in which an ultrasonic oscillator of a frequency of 28 kHz and an ultrasonic oscillator of a frequency of 40 kHz are combined. Further, examples of a combination of ultrasonic oscillators of three kinds of frequencies include: an ultrasonic vibrator in which an ultrasonic oscillator of a frequency of 28 kHz, an ultrasonic oscillator of a frequency of 45 kHz, and an ultrasonic oscillator of a frequency of 100 kHz are combined; an ultrasonic vibrator in which an ultrasonic oscillator of a frequency of 35 kHz, an ultrasonic oscillator of a frequency of 70 kHz, and an ultrasonic oscillator of a frequency of 100 kHz are combined; and other ultrasonic vibrators. It is also possible to use an ultrasonic vibrator in which ultrasonic oscillators of four or more kinds of frequencies are combined. The combination of ultrasonic oscillators of different frequencies is not limited to the above examples, and it is possible to combine appropriately.

Simultaneous Oscillation of at Least Two Different Frequencies

Regarding an ultrasonic vibrator in which ultrasonic oscillators oscillating ultrasonic waves of different frequencies are combined, control can be performed such that all the ultrasonic oscillators simultaneously oscillate ultrasonic waves or such that each group, of ultrasonic oscillators, of the same frequency oscillates each ultrasonic wave at a different timing. Simultaneous oscillation of different frequencies can prevent or reduce an ultrasonic treatment non-uniformity and damage to a treatment target object.

(c) Oscillation of an Ultrasonic Wave of a Variable Frequency

The ultrasonic oscillation unit which drives the ultrasonic oscillators may be equipped with an amplitude modulation circuit (AM modulation circuit) and a frequency modulation circuit (FM modulation circuit). With this arrangement, the oscillation frequency of the ultrasonic vibrator can be varied while the amplitude of vibration is being varied. The fluctuation of the amplitude of vibration may be performed by any of AM modulation and FM modulation or may be performed by a combination of the both. By changing the amplitude of vibration as described above, it is possible to reduce an ultrasonic treatment non-uniformity and damage to the treatment target object.

A strength distribution of sound pressure of the ultrasonic wave transmitted from the ultrasonic vibrator is generated in the treatment liquid, depending on the wavelength of the ultrasonic wave. A surface treatment effect such as cleaning by an ultrasonic wave on a treatment target object is most effective when the sound pressure is the maximum value. Therefore, it is preferable that there be provided a unit to adjust a gap between the ultrasonic vibrator and the treatment target object, depending on the size of the treatment target object or the like. As a unit for adjusting the horizontal distance between the ultrasonic vibrator and the treatment target object, horizontal position adjustment mechanisms shown in FIG. 16 are exemplified.

Figure 16:
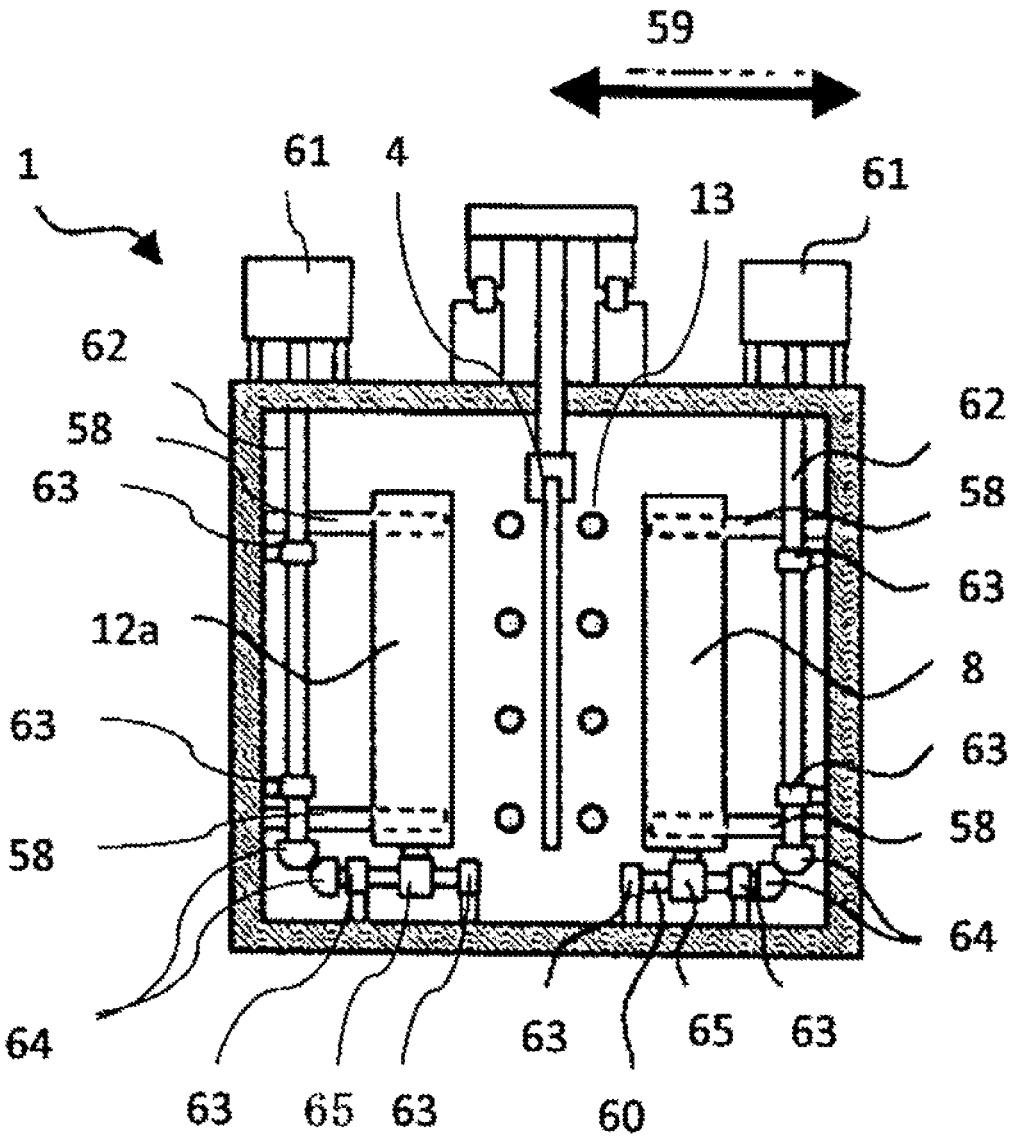
FIG. 16 is a schematic diagram of horizontal position adjustment mechanisms for adjusting distances from the first ultrasonic vibrator and a reflector to a treatment target object, and is a front view of the ultrasonic bath of FIG. 2 when viewed from the Z direction.

FIG. 16 is a schematic diagram of the horizontal position adjustment mechanisms for adjusting the distances from the first ultrasonic vibrator 8 and the reflector 12*a* to the treatment target object 4 and is a front view, viewed from the Z direction, of the ultrasonic bath 1 of FIG. 2. By using the horizontal position adjustment mechanism, the distance between the first ultrasonic vibrator 8 and the treatment target object 4 can be adjusted. The horizontal position adjustment mechanism has: a screw shaft 60 which moves the first ultrasonic vibrator 8; and a drive mechanism which rotates the screw shaft 60. The drive mechanism has a motor 61 for controlling the rotation of the screw shaft, a power source (not shown), and a controller to control the motor 61. The motor 61 and the screw shaft 60 are connected to each other by a shaft 62, which is a rod-like rotation shaft. The shaft 62 is disposed approximately vertically, where one end of the shaft 62 is connected to the motor 61 to transfer a driving force from the motor 61 to the screw shaft 60, and the other end is provided with a bevel gear 64 which is a unit to transfer the rotation to the screw shaft 60. The shaft 62 is rotatably disposed by being passed through openings of bearings 63 fixed on the inner wall of the ultrasonic bath 1. The bevel gear 64 of the shaft 62 is disposed to be connected to the bevel gear 64 provided on one end of the screw shaft 60 in which a spiral thread groove is formed, so that the driving force of the motor 61 can be transferred from the shaft 62 to the screw shaft 60. The other end of the screw shaft 60 is disposed to extend in the direction of the treatment target object 4 so that the screw shaft 60 can be horizontal. On the screw shaft 60, there are attached a bearing 63, a nut 65, and a bearing 63 in this order. The screw shaft 60 is rotatably disposed by being passed through openings of the bearings 63 fixed on the bottom part of the ultrasonic bath 1. Further, the screw shaft 60 is passed through an opening of the nut 65 attached on the bottom surface of the first ultrasonic vibrator 8. On an opening of the nut 65, there are formed a spiral ridge and groove corresponding to a spiral ridge and groove formed on the screw shaft 60, and the rotation of the screw shaft 60 moves the nut 65 on the screw shaft 60. The first ultrasonic vibrator 8 is supported by rails 58 to be able to horizontally slide in the horizontal direction 59, which is the same direction as the disposition direction of the screw shaft 60, in other words, between the treatment target object 4 and the side surface of the ultrasonic bath 1. In the example in the drawing, the rails 58 each are parallely disposed at each of the upper and lower positions of the first ultrasonic vibrator 8; however, in order to move the first ultrasonic vibrator 8 while keeping the posture of the first ultrasonic vibrator 8, the rails 58 are disposed, to be parallel, each at each of the upper, lower, right, and left positions of the first ultrasonic vibrator 8. One ends of the rails 58 are fixed on the side surface of the ultrasonic bath 1, and the rails 58 extend toward the treatment target object 4. The first ultrasonic vibrator 8 has through holes through which the rails 58 pass. When the screw shaft 60 rotates to move the nut 65, the first ultrasonic vibrator 8 supported by the rails 58 is accordingly moved in the horizontal direction 59. The rails 58 and the screw shaft 60 have such lengths that the ultrasonic vibrator 8 having moved does not touch the treatment target object 4. The horizontal portion adjustment mechanism for the reflector 12*a* has a configuration similar to the above configuration.

Figure 17:
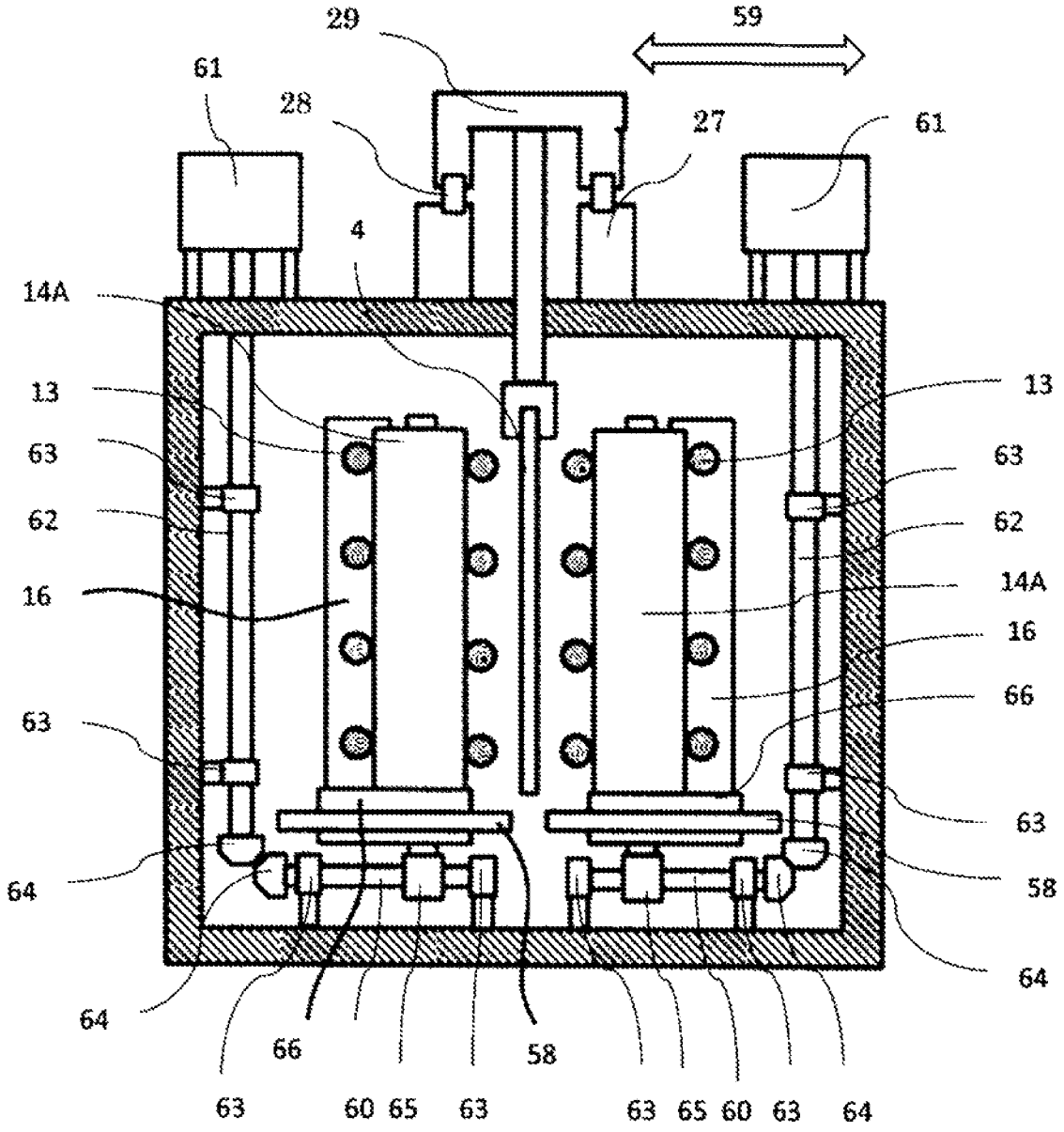
FIG. 17 is a schematic diagram of horizontal position adjustment mechanisms for adjusting distances between the support pillars constituting the guide member and a treatment target object, and is a front view of the ultrasonic bath of FIG. 2 when viewed from the Z direction.

By providing the above horizontal position adjustment mechanism similar to that for the ultrasonic vibrator 8 also on the second ultrasonic vibrator 9, the third ultrasonic vibrator 10, the fourth ultrasonic vibrator 11, and the reflectors 12*b* to 12*d*, the surface treatment effect by an ultrasonic wave can be improved In a preferred embodiment, a configuration similar to the above horizontal position adjustment mechanisms may be provided on the above guide members to adjust the distances between the guide members and the treatment target object 4. By using the above horizontal position adjustment mechanisms and by adjusting depending on the size, in particular, the thickness of the treatment target object, the distances between the guide members and the treatment target object, it is possible to further improve the effect of preventing damage to the treatment target object such as bend and warp. FIG. 17 shows a configuration example in which the above horizontal position adjustment mechanisms are provided on the above guide member.

FIG. 17 is a schematic diagram of the horizontal position adjustment mechanisms for adjusting the distances between the support pillars 14A constituting the guide members and the treatment target object 4 and is a front view of the ultrasonic bath 1 of FIG. 2 when viewed from the Z direction. Each of the horizontal position adjustment mechanisms has a screw shaft 60 which moves a base 66 mounted in such a manner that the support pillar 14A and the fixed pillar 16A are approximately vertical, and a drive mechanism which rotates the screw shaft 60, where the drive mechanism is configured as described above. Further, how the screw shaft 60 and the shaft 62 are configured, disposed, and connected is described above, and the driving force of the motor 61 is transferred from the shaft 62 to the screw shaft 60. The nut 65 is fixed on the bottom part of the base 66. A rod-like rail 58 is fixed on the floor surface of the ultrasonic bath 1 and the like to be horizontal with respect to the screw shaft 60, and the rail 58 is disposed through an opening of the base 66 so that the base 66 can slide on the rail 58. When the rotation of the screw shaft 60 moves the nut 65, the base 66 supported by the rail 58 is accordingly moved in the horizontal direction. With this arrangement, it is possible to adjust the distance between the guide member and the treatment target object 4. By providing a horizontal position adjustment mechanism similar to the above also on the side of the support pillar 14B and the fixed pillar 16B and by moving, in a linking manner, the horizontal position adjustment mechanisms provided on the both side of the guide member, the guide member can be parallely displaced.

Regarding how to drive the horizontal position adjustment mechanism, a high treatment performance can be maintained by recording an appropriate distance between the ultrasonic vibrator and the treatment target object 4, that is, an appropriate distance corresponding to the wavelength of the ultrasonic wave, the size of the treatment target object 4, and the like, in the recording medium of the controller in association with the rotation speed of the motor. That is, because in the case that the treatment target objects 4 are sequentially treated by the ultrasonic treatment apparatus of the present invention, even if the treatment target objects 4 include a treatment target object 4 in a different size, the ultrasonic vibrator can be quickly moved to an appropriate position.

Similarly, by recording an appropriate distance between the guide member and the treatment target object 4, specifically, by recording an appropriate distance corresponding to the size of the treatment target object 4 and the like, in the recording medium of the controller, in association with the rotation speed of the motor, the guide member can be quickly moved to an appropriate position even if a treatment target object 4 in a different size is included in the treatment target objects 4 to be sequentially treated by the ultrasonic treatment apparatus of the present invention.

Note that in the horizontal position adjustment mechanism, the shaft 62 may be manually rotated instead of using the above drive mechanism. For example, instead of the motor 61, a handle such as a rotation handle or a crank handle may be connected to the shaft 62.

Further, as the unit for moving the ultrasonic vibrator and the guide member in the horizontal direction, instead of the above screw and nut, various known horizontal movement units such as an actuator and a cylinder may be used. An instruction of operation from the controller can be transferred to a drive unit such as a motor to operate the actuator or the cylinder so that the ultrasonic vibrator and the support pillar can be moved to a predetermined position.

REFERENCE NUMERALS

1: Ultrasonic bath
2: First ultrasonic bath
3: Second ultrasonic bath
4: Treatment target object
5: Conveyance direction
6: Front bath
7: Rear bath
8: First ultrasonic vibrator
9: Second ultrasonic vibrator
10: Third ultrasonic vibrator
11: Fourth ultrasonic vibrator
12*a*-12*d*: Reflector
13: Wire member
14A, 14B: Support pillar
15A-15J: Folding part
16A, 16B: Fixed pillar
17: Ring roller
18*a*-18*d*: Open/close mechanism
19: Ultrasonic oscillator
20: Plate member
21: Basket
22: Basket conveyance position
23: Conveyance roller
24: Starting point
25: Finishing point
26: Groove
27: Guide rail
28: Conveying roller
29: Fixing part connection base
30: Slit
31: Fixing part
32: Gripping member
33: Central part of an ultrasonic oscillator
34*a*, 34*b*: Horizontal line passing through a central part
35: Fastening part
36: Gate path
37: Fixed member
38: Gate member
39: L-shaped guide rail
40: Fixed member
41: Connection member
42: Rod end
43: Cylinder member
45: Piston rod
46*a*-46*c*: Hinge
48: Crank lever
49: Crank lever thread part
50: Engagement pin
51: Fixing base
52: Fastening member
53: Bearing member
54: Shaft
55: Upper bearing
56: Lower bearing
57: Fastening part
58: Rail
59: Horizontal direction
60: Screw shaft
61: Motor
62: Shaft
63: Bearing
64: Bevel gear
65: Nut
66: Base

What is claimed is:

1. An ultrasonic treatment apparatus comprising:

an ultrasonic bath for performing an ultrasonic treatment on a treatment target object;

a first ultrasonic vibrator having an ultrasonic oscillation surface provided on a front surface side of the treatment target object;

a second ultrasonic vibrator having an ultrasonic oscillation surface provided on a back surface side of the treatment target object;

a first reflector having a reflection surface facing the first ultrasonic vibrator; and a second reflector having a reflection surface facing the second ultrasonic vibrator, wherein the reflection surface of the first reflector is located in front of the ultrasonic oscillation surface of the first ultrasonic vibrator with the treatment target object situated therebetween, wherein the reflection surface of the second reflector is located in front of the ultrasonic oscillation surface of the second ultrasonic vibrator with the treatment target object situated therebetween, and wherein the first ultrasonic vibrator does not face the second ultrasonic vibrator, the reflection surface of the first reflector is configured to reflect an ultrasonic wave transmitted from the first ultrasonic vibrator back along a same path of approach to the back surface side of the treatment target object, and the reflection surface of the second reflector is configured to reflect an ultrasonic wave transmitted from the second ultrasonic vibrator back along a same path of approach to the front surface side of the treatment target object.

2. The ultrasonic treatment apparatus according to claim 1, wherein each of the ultrasonic vibrators includes a plurality of ultrasonic oscillators and a plate member provided in contact with an ultrasonic oscillation side of the ultrasonic oscillators.

3. The ultrasonic treatment apparatus according to claim 2, wherein the ultrasonic bath further includes:

a third ultrasonic vibrator provided on the front surface side of the treatment target object; and a fourth ultrasonic vibrator provided on the back surface side of the treatment target object, wherein the ultrasonic oscillators are disposed such that any horizontal lines passing through central parts of the ultrasonic oscillators constituting the first ultrasonic vibrator does not overlap any horizontal lines passing through central parts of the ultrasonic oscillators constituting the third ultrasonic vibrator, and such that any horizontal lines passing through central parts of the ultrasonic oscillators constituting the second ultrasonic vibrator does not overlap any horizontal lines passing through central parts of the ultrasonic oscillators constituting the fourth ultrasonic vibrator.

4. The ultrasonic treatment apparatus according to claim 1, wherein the ultrasonic treatment apparatus further includes a conveyance mechanism for the treatment target object.

5. The ultrasonic treatment apparatus according to claim 1, further comprising:

a front bath provided on an entrance side of the ultrasonic bath; and a rear bath provided on an exit side of the ultrasonic bath, wherein open/close mechanisms which open toward an ultrasonic bath side is provided between the baths.

6. An ultrasonic treatment apparatus comprising:

an ultrasonic bath for performing an ultrasonic treatment on a treatment target object;

an ultrasonic vibrator which transmits an ultrasonic wave toward the treatment target object;

a conveyance mechanism for the treatment target object;

a guide member facing a front surface of the treatment target object; and a guide member facing a back surface of the treatment target object, wherein each of the guide members has a plurality of wire members formed on a vertical plane, and a longitudinal direction of each of the wire members being inclined with respect to the horizontal line.

7. The ultrasonic treatment apparatus according to claim 6, wherein each of the guide members includes:

support pillars at each end of the longitudinal direction of the plurality of wire members; and folding parts for the wire members being provided close to the support pillar, wherein each of the wire members passes through an outer circumference of one of the support pillars and is folded back at one of the folding parts, and then passes through the outer circumference of the one of the support pillars and is stretched to the other of the support pillars.

8. An ultrasonic treatment apparatus comprising:

an ultrasonic bath for performing an ultrasonic treatment on a treatment target object;

an ultrasonic vibrator which transmits an ultrasonic wave toward the treatment target object;

a conveyance mechanism for the treatment target object;

a guide member facing a front surface of the treatment target object; and a guide member facing a back surface of the treatment target object, wherein each of the guide members has a plurality of wire members formed on a vertical plane, and a longitudinal direction of each of the wire members being inclined with respect to the horizontal line, wherein the wire members have conductivity to conduct electricity from a power supply.

9. The ultrasonic treatment apparatus according to claim 7, wherein each of the support pillars has a groove formed in a spiral manner.

10. The ultrasonic treatment apparatus according to claim 7, wherein each of the support pillars is provided with a horizontal position adjustment mechanism to adjust a distance to the treatment target object.

11. The ultrasonic treatment apparatus according to claim 6, wherein each of the ultrasonic vibrators is configured with a plurality of ultrasonic oscillators which oscillates at different frequencies.

12. The ultrasonic treatment apparatus according to claim 6, wherein each of the ultrasonic vibrators simultaneously oscillates at at least two different frequencies.

13. The ultrasonic treatment apparatus according to claim 6, wherein each of the ultrasonic vibrators is driven at a variable frequency.

14. The ultrasonic treatment apparatus according to claim 6, wherein each of the ultrasonic vibrators is provided with a horizontal position adjustment mechanism to adjust a distance to the treatment target object.

* * * * *